US006668148B2

(12) United States Patent
Hirano et al.

(10) Patent No.: US 6,668,148 B2
(45) Date of Patent: Dec. 23, 2003

(54) LATENT ELECTROSTATIC IMAGE DEVELOPING APPARATUS AND IMAGE FORMING APPARATUS INCLUDING SUCH DEVELOPING APPARATUS

(75) Inventors: Yasuo Hirano, Kanagawa (JP); Naoya Morohoshi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/024,047

(22) Filed: Dec. 18, 2001

(65) Prior Publication Data

US 2002/0191990 A1 Dec. 19, 2002

(30) Foreign Application Priority Data

Dec. 20, 2000 (JP) ..... 2000-387955
Mar. 13, 2001 (JP) ..... 2001-070966
Mar. 14, 2001 (JP) ..... 2001-073062

(51) Int. Cl.[7] ..... G03G 15/08
(52) U.S. Cl. ..... 399/284; 399/286
(58) Field of Search ..... 399/286, 265, 399/279, 284, 274; 430/120

(56) References Cited

U.S. PATENT DOCUMENTS 5,287,150 A * 2/1994 Kinoshita et al. ..... 399/284
5,875,379 A * 2/1999 Machida et al. ..... 399/284
6,163,669 A * 12/2000 Aoki et al. ..... 399/265
6,266,508 B1 * 7/2001 Nakagawa et al. ..... 399/286
RE37,429 E 10/2001 Nojima et al.
6,376,087 B1 * 4/2002 Ozeki et al. ..... 399/279

FOREIGN PATENT DOCUMENTS

| | | |
|---|---|---|
| JP | 61-23171 | 1/1986 |
| JP | 63-364 | 1/1988 |
| JP | 3-012676 | 1/1991 |
| JP | 4-007568 | 1/1992 |
| JP | 4-019761 | 1/1992 |
| JP | 4-022979 | 1/1992 |
| JP | 4-247478 | 8/1992 |
| JP | 6-149031 | 5/1994 |
| JP | 8-211726 | 8/1996 |
| JP | 8-248769 | 9/1996 |
| JP | 8-328381 | 12/1996 |
| JP | 9-050185 | 2/1997 |
| JP | 9-292768 | 11/1997 |

* cited by examiner

*Primary Examiner*—Susan S. Y. Lee
(74) *Attorney, Agent, or Firm*—Cooper & Dunham LLP

(57) ABSTRACT

Apparatus for developing a latent electrostatic image to a developed image with a developer, having a developer bearing member capable of carrying developer on a surface thereof, and a layer thickness regulating member for regulating developer carried on the developer bearing member to a uniform thickness, wherein at least the surface of the layer thickness regulating member is made of a material which includes at least one of a cross-linked alkylalkoxyl-group-containing nylon resin and a cyclic polyolefin.

20 Claims, 14 Drawing Sheets

Figure to explain the toner movement

LATENT ELECTROSTATIC IMAGE DEVELOPING APPARATUS AND IMAGE FORMING APPARATUS INCLUDING SUCH DEVELOPING APPARATUS

BACKGROUND OF THE INVENTION

1. Field of the Invention

This invention relates to a developing apparatus for making latent electrostatic images visible in an electrophotographic apparatus or electrostatic recording apparatus, and to an image forming apparatus capable of obtaining high-quality images using the developing apparatus.

2. Description of the Related Art

Conventionally, developing apparatus utilizing a single-component toner supplies developer to the surface of a developer bearing member (herein after also referred to as a toner carrier, developer roller, etc.) by an elastic roller of sponge or the like which rotates, electrically charges the developer and causes it to adhere, restricts the thickness of the developer layer by a blade or roller-shaped layer thickness regulating member, forms a uniform thin layer of developer on the surface of the developer bearing member, causes it to adhere to a latent electrostatic image formed on a latent image carrier, develops that, and turns it into a visible image.

At such time, there have been the following problems with the layer thickness regulating member.

Conventionally, for the surface member of the layer thickness regulating member, in view of the fact that the electrostatic charging characteristics of the developer are affected by the frictional electrostatic charging characteristics of the various members, when a negatively charged developer is used, a positively charged material has sometimes been used for the purpose of increasing the developer charge or conversely decreasing the oppositely charged developer.

In particular, because nylon materials exhibit very strong positive charging qualities, they have been frequently used for the purpose of improving the charging characteristics of developers. Examples include nylon and polyether copolymers (Japanese Patent Application Laid-Open No. H9-50185/1997), nylons having specific mechanical properties (Japanese Patent Application Laid-Open No. H8-328381/1996), and nylons formed on urethane rubber (Japanese Patent Application Laid-Open No. H8-248769/1996). Developer bearing members are generally classified in two types, hard and soft types according to the shape of the photo-sensitive member (drum or belt) and developing method (contact or non-contact), and layer thickness regulating member are needed which accord therewith.

However, nylon materials exhibit poor releasability, leading to problems such as that the developer strongly adheres to the surface of the layer thickness regulating member, so-called toner sticking occurs, the charging characteristics of the developer changes over time, and the phenomenon of streaks or irregularities occurring in the thin developer layer arises.

Also, when the coefficient of friction ($\mu$) of the layer thickness regulating member is large, toner aggregates or foreign matter is sandwiched between parts of the layer thickness regulating member and developer roller that are in contact, and streaks occur in the thin toner layer, making it difficult to obtain a uniform stable thin layer.

Meanwhile, as a method of maintaining long life of a developing apparatus (hereinafter also referred to as a developing unit), as affected by toner sticking, developing apparatuses have been proposed (cf. Japanese Utility Model Application Laid-Open No. S63-364/1988 (published), for example) wherein, a thin layer roller driven to turn in the same direction as the developer roller by a drive source is made to contact the developer roller.

Here, the turning speed of the developer roller is set to a prescribed speed that satisfies the developing conditions, and the turning speed of the thin layer roller is set so that the thin layer roller turns at a very low speed.

In this developing apparatus, the thin layer roller that makes the toner adhering to the surface of the developer roller a thin layer contacts the developer roller at only one place, and the place where the thin layer roller contacts the developer roller (toner carrier) changes due to the turning of the thin layer roller, wherefore, as compared to the developer blade, it is difficult for toner sticking to occur on the thin layer roller, and useful life extension was expected.

However, in the above-described developing apparatuses wherein a thin layer roller is used, there was a problem, as described below, caused by toner aggregates that were generated inside the developing apparatuses.

That is, whereas the supply roller functioning as the toner supply member is generally made of a sponge material, when the sliding contact between the developer roller and the supply roller is repeated as the developing apparatus is used, portions of the sponge configuring the supply roller are torn away and circulate as minute foreign matter together with the toner inside the developing apparatus. When the developing apparatus is used over an extended period, toner adheres to the minute pieces of sponge torn away as described in the foregoing when toner is rubbed between the developer roller and the supply roller or between the developer roller and the thin layer roller, and toner fuses with toner at the site of that sliding contact, whereupon toner aggregates are generated.

These toner aggregates that are generated follow along the normal flow of toner and reach the vicinity of sliding contact between the developer roller and thin layer roller. The thin layer roller turns in the same direction as the developer roller, and renders the toner adhering to the surface of the developer roller into a thin layer. However, the turning speed of the developer roller is set at a prescribed speed which satisfies the developing conditions, whereas the turning speed of the thin layer roller is set so that the thin layer roller turns at a very low speed.

For that reason, toner aggregates that have gotten into the wedge-shaped portion at the entrance to the sliding contact region between the developer roller and the thin layer roller either are returned back to the interior of the developing apparatus without entering that sliding contact region, or enter into that sliding contact region. The toner aggregates that have entered the sliding contact region are used in the developing of the latent electrostatic images, causing anomalous images to be generated, or remain in the sliding contact region and adhere strongly to the surface of the thin layer roller, creating portions where no thin layer will be formed and causing white streaks in the images.

Furthermore, when the developing apparatus continues to be used with the toner aggregates present in the sliding contact region between the developer roller and the thin layer roller, the surfaces of the developer roller and thin layer roller where the toner aggregates make contact will deteriorate, and it will become impossible to obtain the desired thin toner film on the developer roller. For that reason, it is necessary to enhance the thin layer roller toner releasability, and prevent the aggregates from adhering to the thin layer roller surface.

In addition to the aggregates, moreover, toner also melts and adheres in a thin film form to the thin layer roller surface in what is called toner filming, and there has been hoped that thin layer roller surface toner releasability can be further improved.

As means for eliminating the difficulties described in the foregoing, the method of deploying a fluorine resin excelling in toner releasability to the thin layer roller surface is adopted. In addition to coating on the fluorine resin coating material by an ordinary method such as spraying or roll coating, this can be accomplished by mounting a fluorine resin tube to the thin layer roller surface.

However, although fluorine resins are very outstanding in terms of releasability and the difficulties noted earlier are eliminated, positioned, in triboelectric series, on the extreme negatively charged side, wherefore difficulties arise in that, especially when using a negatively charged toner, the toner charge amount is low, or, for that reason, a thin toner layer is not formed uniformly, or, when the fluorine content is decreased and the toner charging quality improved, toner releasability declines. Thus, even for the method in which a thin layer roller is employer, further improvement in toner releasability on the surface of the thin layer roller has been desired.

Furthermore, ordinarily, when developing a toner on a latent electrostatic image carrier, a broad division is made between developing methods wherein the developer roller and the latent electrostatic image carrier are not in contact and methods wherein they are in contact. As a general practice, the developer roller used is elastic or rigid, as necessary. Ordinarily, a rigid developer roller is often used in contact developing in which a belt-form latent electrostatic image carrier is used, or in non-contact developing.

At such time, in order to secure a suitable sliding contact portion between the thin layer roller and the developer roller, it becomes necessary to have a suitable degree of elasticity on the thin layer roller side. However, because toner releasability is poor when a rubber roller is used as is, a surface layer is generally provided to effect improvement, but when the flexibility is raised enough so that the elasticity of the rubber layer can be followed, releasability deteriorates, and the difficulties described earlier are encountered, constituting a problem.

Meanwhile, developer rollers also posed problems as described below. When a developer roller is used in, among those single-component developing schemes, a contact developing scheme wherein the developer roller and the photo-sensitive member are in a contacting condition.

With such a scheme, in order to cause the developer roller and the photo-sensitive member to stably contact each other, it is particularly necessary to impart flexibility to the structure or material of one or the other, or of both. For that reason, flexible materials and/or structures have been used, namely, an ending or endless belt for the photo-sensitive member, and rubber or sponge or the like for the developer roller.

However, in terms of apparatus cost, it is more economical to use a drum as the photo-sensitive member than a belt, for which reason there is a demand to impart even greater flexibility to the developer roller.

The developer roller surface member used in a developing apparatus is continually in contact with the toner, wherefore that member needs to exhibit outstanding toner releasability and wear resistance, while exhibiting little deterioration in properties. Conventionally, a number of materials have been proposed therefor.

In terms of examples wherein materials of outstanding wear resistance are used, many materials have been proposed, such as resins reinforced with the dispersion of carbon fiber therein (Japanese Patent Application Laid-Open No. S61-23171/1986 (published)), examples wherein glass powder is contained in ceramic coating material (Japanese Patent Application Laid-Open No. H4-7568/1992 (published)), certain silica-containing silicone rubbers (Japanese Patent Application Laid-Open No. H9-292768/1997 (published)), and examples wherein the surface is coated with a polyamide (Japanese Patent Application Laid-Open No. H6-149031/1994 (published)).

There are also examples wherein releasability has been improved, such as examples wherein a phenol resin surface coating film containing electroconductive carbon and graphite is formed (Japanese Patent Application Laid-Open No. H3-12676/1991 (published), examples wherein a titanate coupling agent is used (Japanese Patent Application Laid-Open No. H4-19761/1992 (published), examples wherein a fluorine-based surfactant is contained (Japanese Patent Application Laid-Open No. H4-22979/1992 (published)), and examples wherein a solid lubricant is used (Japanese Patent Application Laid-Open No. H8-211726/1996 (published)).

There are, in addition thereto, examples that seek to resolve the problems with both properties such as examples wherein crystalline and amorphous polyamide resins are mixed (Japanese Patent Application Laid-Open No. H4-247478/1992 (published)).

Nevertheless, in the conventional examples noted above, in those where toner releasability is outstanding, there will be surfaces that prevent the adhesion of toner due to the fact that the surface is gradually worn away, wherefore it has been very difficult to realize both releasability and wear properties together.

SUMMARY OF THE INVENTION

In order to eliminate the above problem, an object of the present invention is to provide a developing apparatus having excellent toner releasability with respect to a layer thickness regulating member or developer bearing member. More specifically, the present invention provides a developing apparatus wherein developer charging qualities that are stable over time and a uniform thin layer of developer can be obtained, and the generation of reverse charged toner is reduced, and to provide a developing apparatus wherein a uniform stable thin toner layer is obtained even when the developer bearing member is a rigid member.

An embodiment of the present invention provides a developing apparatus having a thin layer roller employed, in which a thin layer roller having elasticity can also be employed and with which toner filming and aggregate adhesion do not occur on the surface of the thin layer roller when used for an extended period, and further provides a developing apparatus with which the toner charging characteristics have been improved and generation of reverse charged toner is reduced.

Another embodiment of the present invention provides a developing unit and image forming apparatus wherein both the toner releasability and wear resistance of the developer roller are satisfactory, and a stable thin toner layer is obtained.

Further, the present invention has an object to provide a high-image-quality, highly durable image forming apparatus.

The first embodiment of the present invention is a developing apparatus for developing a latent electrostatic image to a developed image with a developer, comprising a developer bearing member capable of bearing the developer on a surface portion of the developer bearing member, and a layer thickness regulating member for regulating the thickness of said developer on the developer bearing member to a uniform thickness, the surface portion of the layer thickness regulating member comprising a material which comprises at least one component selected from the group consisting of a cross-linked alkylalkoxyl-group containing nylon resin and a cyclic polyolefin.

The second embodiment of the present invention is a developing apparatus of the first embodiment, wherein the surface portion of said layer thickness regulating member has a volume resistivity of $10^{12}$ Ωcm or less.

The third embodiment of the present invention is a developing apparatus of the first embodiment, wherein said layer thickness regulating member has an elastic layer.

The fourth embodiment of the present invention is a developing apparatus of the first embodiment, wherein the layer thickness regulating member is a roller.

The fifth embodiment of the present invention is a developing apparatus of the fourth embodiment, wherein the material comprising the cyclic polyolefin and a polyethylene wax.

The sixth embodiment of the present invention is a developing apparatus of the fourth embodiment, wherein the material comprising the cyclic polyolefin, and a compound that is positioned, in triboelectric series, more to positive charge side than the polyolefin.

The seventh embodiment of the present invention is a developing apparatus of the first embodiment, wherein the nylon resin containing crosslinked alkylalcoxyl group is obtained using 30 parts by weight or less of a crosslinking agent to 100 parts by weight of said nylon resin containing alkylalcoxyl group.

The eighth embodiment of the present invention is a developing apparatus of the first embodiment, wherein the nylon resin containing crosslinked alkylalcoxyl group is obtained using a silane coupling agent as crosslinking agent.

The ninth embodiment of the present invention is a developing apparatus of the eighth embodiment, wherein the silane coupling agent is an aminosilane coupling agent.

The tenth embodiment of the present invention is a developing apparatus of the first embodiment, wherein the alkylalcoxyl group is a methylmethoxyl group.

The eleventh embodiment of the present invention is a developing apparatus of the first embodiment, wherein at least the surface of the developer bearing member comprises a material comprising polyimide denatured silicone.

The twelfth embodiment of the present invention is a developing apparatus of the first embodiment, wherein the surface portion of said developer bearing member has a volume resistivity of $10^{12}$ Ωcm or less.

The thirteenth embodiment of the present invention is a developing apparatus of the first embodiment, wherein the developer bearing member has an elastic layer.

The fourteenth embodiment of the present invention is a developing apparatus of the eleventh embodiment, wherein the material comprises 15 parts by mass or more of at least one of a maleimide resin having a group of quaternary ammonium salt and a methacrylimide resin having a group of quaternary ammonium salt to 100 parts by mass of said polyimide denatured silicone.

The fifteenth embodiment of the present invention is a developing apparatus for supplying developer to latent electrostatic images and making those latent electrostatic images visible to form developed images, comprising a developer bearing member capable of carrying developer on the surface thereof, and a layer thickness regulating member for regulating developer carried on the developer bearing member to a uniform thickness, wherein at least the surface of the developer bearing member is formed of a material comprising mainly of a polyimide denatured silicone.

With the constitution of the present invention as described above, the use of polyimide denatured silicone resin having excellent releasability and abrasion resistance on the surface of the developer roller make it possible to obtain a developing apparatus which causes no toner retention, and provides toner with stable toner electrostatic properties and the thin layer with stable uniformity because of its desirable resistance to abrasion.

The sixteenth embodiment of the present invention is the developing apparatus according to the fifteenth embodiment described above, wherein the surface portion of the developer bearing member has a volume resistivity of $10^{12}$ Ωcm or less.

The seventeenth embodiment of the present invention is the developing apparatus according to the fifteenth embodiment described above, wherein the developer bearing member has an elastic layer.

The eighteenth embodiment of the present invention is the developing apparatus according to the fifteenth embodiment, wherein the material comprising mainly of polyimide denatured silicone contains 15 parts by mass or more of at least one of a maleimide resin containing a quaternary ammonium salt and a methacrylimide resin containing a quaternary ammonium salt to 100 parts by mass of the polyimide denatured silicone.

With the constitution described above, it is possible to obtain a developing unit which not only can control the resistance uniformly but also control the electrostatic property of the toner on the developer roller at the same time.

The nineteenth embodiment of the present invention is an image forming apparatus comprising a latent electrostatic image bearing means capable of bearing latent electrostatic images thereon, charging means for electrically charging the surface of the latent electrostatic image bearing means, exposing means for exposing the surface of the electrically charged latent electrostatic image bearing means to light imagewise so as to form a latent electrostatic image thereon corresponding to an image to be formed, a developing member comprising a develop unit for supplying the developer to the latent electrostatic image and developing the latent electrostatic image to a developed image with the developer, which developing unit comprises, (a) a developer bearing member capable of bearing the developer on a surface portion of the developer bearing member, and (b) a layer thickness regulating member for regulating the thickness of a layer of the developer on the developer bearing member to a uniform thickness, the surface portion of the layer thickness regulating member comprising a material which comprises at least one component selected from the group consisting of a cross-linked alkylalkoxyl-group-containing nylon resin and a cyclic polyolefin.

The twentieth embodiment of the present invention is an image forming apparatus comprising a latent electrostatic image bearing means capable of bearing latent electrostatic images thereon, charging means for electrically charging the surface of the latent electrostatic image bearing means, exposing means for exposing the surface of the electrically charged latent electrostatic image bearing means to light imagewise so as to form a latent electrostatic image thereon corresponding to an image to be formed, a developing member comprising a develop unit for supplying the developer to the latent electrostatic image and developing the latent electrostatic image to a developed image with the developer, which developing unit comprises,(a) a developer bearing member capable of bearing the developer on a surface portion of the developer bearing member, and (b) a layer thickness regulating member for regulating the thickness of a layer of the developer on the developer bearing member to a uniform thickness, the surface portion of the developer bearing member comprising a material containing a polyimide denatured silicone.

With the constitution described above, it is possible to obtain an image forming apparatus having high image quality and high durability.

DESCRIPTION OF THE PREFERRED EMBODIMENTS

The present invention will now be described in detail.

The developing apparatus of the present invention is a developing apparatus that supplies developer to the latent electrostatic image, makes that latent electrostatic image visible, and forms a developed image, comprising a developer bearing member capable of carrying developer on the surface thereof, and a layer thickness regulating member for regulating the developer carried on that developer bearing member to a uniform thickness, wherein at least the surface in the layer thickness regulating member is formed of a material comprising mainly of at least one of a crosslinked nylon resin member containing an alkylalcoxyl group and an cyclic polyolefin.

Figure 1:
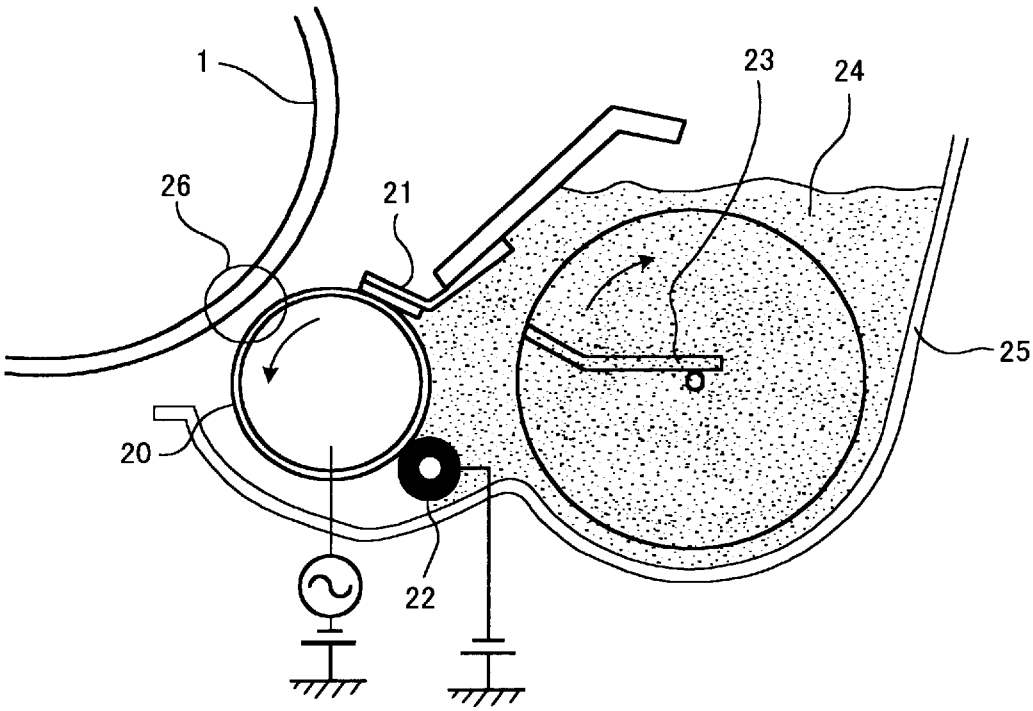
FIG. 1 is a schematic view of an example of configuration featuring mainly the developer bearing member unit relating to an embodiment of the developing apparatus of the present invention.

FIG. 1 is a schematic view of a configuration featuring mainly the developer bearing member unit of a typical developing apparatus that is useful in embodying the developing apparatus of the present invention.

In FIG. 1, toner 24 held in a toner tank 25 is forcibly brought near a toner supply member (sponge roller, fur brush 14, and the like) 22 by a stirring blade 23 (toner replenishment member) 23, whereupon the toner 24 is supplied to the toner supply member 22. Meanwhile, a developer bearing member (developer roller) 20 for which developing has been finished turns in the direction indicated by the arrow, and reaches a place where it makes contact with the toner supply member 22. The toner supply member 22 turns either in the same direction as or in the reverse direction of the developer bearing member 20, and, while imparting an electrical charge to the toner 24, causes the toner 24 to adhere to the developer bearing member 20. The developer bearing member 20 turns, furthermore, and the toner 24 adhering to the developer bearing member 20 has its charge stabilized while the thickness thereof is controlled by a layer thickness regulating member 21, and reaches a developing area 26. In the developing area 26, a latent image is developed, by either contact or non-contact developing. Here, as necessary, direct current, alternating current, alternating current superimposed on a direct current, or pulses or the like are applied to the developer bearing member 20, layer thickness regulating member 21, and toner supply member 22, and optimum images can be controlled.

The nylon that contains a alkylalkoxy group that is used at least on the surface of the layer thickness regulating member 21 in the present invention is ordinary nylon such as 6 nylon or 12 nylon wherein some of the amide groups have been made alkoxyalkyl. Such alkylalkoxy group is preferably a methylmethoxyl group, methylethoxy group, and methylbutoxy group, and a methylmethoxyl group is particularly preferable. The nylon having a methylmethoxyl group can be expressed by the chemical formula below.

Formula 1

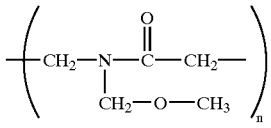

This is characterized in that it is readily dissolved in a lower alcohol such as methanol, ethanol, propanol, or butanol, capable of being coated on in a thin film by spraying or dipping. Even if molded on a rubber roller, moreover, it does not fracture because it is flexible, and is well suited as a surface material for elastic rollers.

Specific examples of such materials include N-(methoxymethyl) nylon 12 (product name: Torejin EF30T, F30K, and. G550, made by Teikoku Chemical Industries Co., Ltd.; product name: Fairejin FR101, FR104, and FR301, made by (KK) Namariichi).

Further, the above-mentioned ethoxy-denatured products, butoxy-denatured products, Si-containing alcohol-denatured products, and Si-containing alcoxide-denatured products of such N-(methoxymethyl) nylon are also used.

As a method for crosslinking the nylon resin containing an alkylalkoxy group used in the present invention., there is the method of performing intermolecular crosslinking by subjecting the nylon containing the alkylalkoxy group to a dealcohol reaction, such as that represented by the reaction formula given below, in the presence of an acid catalyst such as an organic acid like citric acid or tartaric acid, an inorganic acid like boric acid or hypophosphorous acid, or the like.

Acid Catalyst $$—N—CH_2—O—CH_3+CH_3—O—CH_2$$

$$—N—\rightarrow—N—CH_2—O—H_2—N—+$$

$$2CH_3OH$$

Anything can be used as the crosslinking agent so long as it contains a plural number of functional groups capable of reacting with the alkylalkoxy group in the molecule. Typical crosslinking agents include a compound containing a hydroxyl group or methylol group or the like in the molecule. In addition to low-molecular materials, it is also possible to use high-molecular materials if they are miscible with the nylon resin containing the alkylalkoxy group, with examples thereof including such amino resins as melamine resins, guanamine resins, and ureic resins, for example, and phenol resins and the like. By using such crosslinking agents as these, it is possible to improve the characteristics of the layer thickness regulating member 21.

A silane coupling agent is preferable for the crosslinking agent for the above-mentioned nylons. Silane coupling agents are expressed by the general formula:

Y~SiX, where Y represents an organic functional group typified by the amino, epoxy, vinyl, methacryl, and mercapto groups, while X represents a hydrolytic group typified by the alcoxy group.

By crosslinking the nylon resin having the methylmethoxyl group with a silane coupling agent, the coefficient of friction($\mu$) of the layer thickness regulating member 21 is lowered. By lowering the coefficient of friction ($\mu$), a uniform stable thin toner layer can be formed even more readily, and such as torque reduction is also achieved. A coefficient of friction ($\mu$) of 0.5 or lower is preferred.

Specific examples of the above-mentioned silane coupling agents include those expressed by the chemical formulas below.

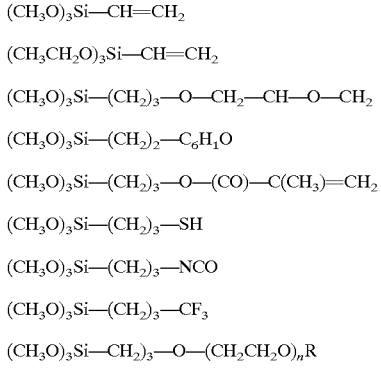

$$(CH_3O)_3Si—CH=CH_2$$

$$(CH_3CH_2O)_3Si—CH=CH_2$$

$$(CH_3O)_3Si—(CH_2)_3—O—CH_2—CH—O—CH_2$$

$$(CH_3O)_3Si—(CH_2)_2—C_6H_1O$$

$$(CH_3O)_3Si—(CH_2)_3—O—(CO)—C(CH_3)=CH_2$$

$$(CH_3O)_3Si—(CH_2)_3—SH$$

$$(CH_3O)_3Si—(CH_2)_3—NCO$$

$$(CH_3O)_3Si—(CH_2)_3—CF_3$$

$$(CH_3O)_3Si—CH_2)_3—O—(CH_2CH_2O)_nR$$

Among these silane coupling agents, those having an amino group in the molecule are most preferable. The amino group has an electron donor property, wherefore it can improve the frictional electrostatic charging characteristics of the toner 24, and is capable in particular of increasing the amount of toner charge. Specific examples of aminosilane coupling agents include those expressed by the chemical formulas below.

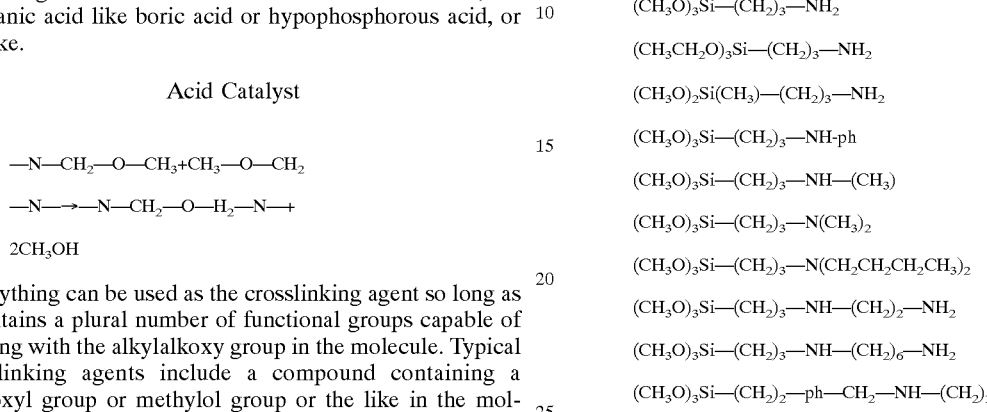

$$(CH_3O)_3Si—(CH_2)_3—NH_2$$

$$(CH_3CH_2O)_3Si—(CH_2)_3—NH_2$$

$$(CH_3O)_2Si(CH_3)—(CH_2)_3—NH_2$$

$$(CH_3O)_3Si—(CH_2)_3—NH\text{-}ph$$

$$(CH_3O)_3Si—(CH_2)_3—NH—(CH_3)$$

$$(CH_3O)_3Si—(CH_2)_3—N(CH_3)_2$$

$$(CH_3O)_3Si—(CH_2)_3—N(CH_2CH_2CH_2CH_3)_2$$

$$(CH_3O)_3Si—(CH_2)_3—NH—(CH_2)_2—NH_2$$

$$(CH_3O)_3Si—(CH_2)_3—NH—(CH_2)_6—NH_2$$

$$(CH_3O)_3Si—(CH_2)_2—ph—CH_2—NH—(CH_2)_2—NH_2$$

Adding these catalysts and crosslinking agents to the nylon can be done using a direct kneading procedure using a kneader, two-roll mixer, triple-roll mixer, or Banbury mixer or the like, but there is also the wet method of dispersing such additives in nylon which has been dissolved in a lower alcohol or the like beforehand. For the dispersing means used to obtain a dispersion by the wet dispersion procedure, such commonly known methods as those using a ball mill, attritor, sand mill, vibrating mill, disk vibrating mill, paint shaker, or jet mill or the like are used.

For the method of applying the coating liquid, an immersion coating method, spray coating, beat coating, nozzle coating, spinner coating, or ring coating or the like can be used.

These coating layers can be adequately heated and dried under prescribed conditions and can be crosslinked. Preferable heating conditions are a temperature of 80 to 150° C. for a time of 10 minutes to 3 hours.

By making the volume resistance of the crosslinked nylon resin containing alkylalkoxy groups formed on the surface of the layer thickness regulating member 21 in the present invention $10^{12}$ Ωcm or less, it is possible to reduce the amount of reverse charged toner on the developer bearing member 20. It is also possible to apply a bias between the developer bearing member 20-developer-layer thickness regulating member 21.

An ordinary resistance controlling material can be used for the nylon resistance control. Such materials are largely divided between electroconductive particles and ion-electroconductive materials.

Such electroconductive particles include electroconductive carbon blacks such as Ketjenblack and acetylene black, electroconductive metal oxides such as tin oxide, titanium oxide, and zinc oxide, and metal particles such as nickel and copper, together with graphite and pyrolytic carbon. In this case, the amount of electroconductive particles added to 100 parts by weight of nylon should be from 5 to 100 parts by weight. When the amount added is too small, the resistance does not adequately decline, whereas when too large, releasability declines and toner filming occurs.

Ion-electroconductive materials include, for example, ammonium salts such as perchloric acid salts of ammonium like tetraethyl ammonium, tetrabutyl ammonium, lauryl-trimethyl ammonium, stearyl-trimethyl ammonium, octadecyl-trimethyl ammonium, dodecyl-trimethyl ammonium, hexadecyl-trimethyl ammonium, benzyl-trimethyl ammonium, and denatured fatty acid dimethyl-ethyl ammonium, chloric acid salts, hydrochloric acid salts, boric acid salts, iodic acid salts, hydroborofluoric acid salts, sulfuric acid salts, alkyl sulfuric acid salts, carbonic acid salts, and sulfonic acid salts, and perchloric acid salts, chloric acid salts, hydrochloric acid salts, boric acid salts, iodic acid salts, hydroborofluoric acid salts, trifluorimethyl sulfuric acid salts, and sulfonic acid salts and the like of alkaline earth metals or alkali metals such as lithium, sodium, calcium, or magnesium. In these cases, the amount of ion-electroconductive agent added to 100 parts by weight of the nylon should be from 0.5 to 20 parts by weight. When the amount added is too small, resistance does not adequately decline, and when too large, releasability declines and toner filming occurs.

In addition to the crosslinking agents and resistance controlling agents described in the foregoing, various compounds, resins, or particles or the like can be added, as necessary to improve various characteristics, to the nylon containing alkylalkoxy groups.

A description is given next of the thin layer roller used in the developing apparatus of the present invention. The thin layer roller used in the developing apparatus of the present invention is such that at least the surface thereof is configured by a material comprising mainly of an cyclic polyolefin.

The material mainly comprising of an cyclic polyolefin used at least in the surface of the layer thickness regulating member 21 is a polymer in which an cyclic olefin is the main component, bonded inside the main chain, and the crystallinity of polymers based on straight chain olefins is changed to non-crystallinity, and to which higher transparency, low birefringence, heat resistance, and chemical resistance and the like are imparted. All such materials commonly known as such are included in the scope of the invention.

Such polymers are represented by two: simple cyclic polyolefin obtained adding water after ring scission polymerization of norbornene that is common as cyclic olefine, and copolymer cyclic polyolefin made by the addition polymerization of norbornene and a straight chain olefin such as ethylene. Commonly known simple cyclic polyolefins include "Arton" (trademark) marketed by JSR and "Zeonex" (trademark) marketed by Nippon Zeon Co., Ltd., while a copolymer cyclic polyolefin called "Apel" (trademark) is marketed by Mitsui Chemicals, Inc.

The above-mentioned cyclic polyolefins can have another polymer blended therein as necessary. Such other polymers that can be cited include, for example, elastomeric polymers and other thermoplastic resins.

Elastomeric polymers that can be cited include, for example, diene rubbers such as polybutadiene rubber, polyisoprene rubber, and acrylonitrile-butadiene copolymer rubber, styrene butadiene copolymer rubber, styrene isoprene copolymer rubber, styrene butadiene isoprene terpolymer, hydrogenated diene rubbers, saturated polyolefin rubbers including ethylene α-olefin copolymers such as ethylene propylene copolymers, and propylene and other α-olefin copolymers, α-olefin diene copolymer rubbers such as ethylene propylene diene copolymers, α-olefin diene copolymers, isobutylene isoprene copolymers, and isobutylene diene copolymers, special rubbers such as urethane rubber, silicone rubber, polyether rubber, acrylic rubber, propylene oxide rubber, and ethylene acrylic rubber, thermoplastic elastomers such as styrene butadiene styrene block copolymer rubber and styrene isoprene styrene block copolymer rubber, hydrogenated thermoplastic elastomers, urethane-based thermoplastic elastomers, polyamide-based thermoplastic elastomers, and 1,2-polybutadiene thermoplastic elastomers.

Other thermoplastic resins that can be cited include, for example, such polyolefins as low-density polyethylene, high-density polyethylene, straight-chain low-density polyethylene, super low-density polyethylene, polypropylene, polybutene, and polypentene, such polyesters as polyethylene terephthalate and polybutylene terephthalate, such polyamides as nylon 6 and nylon 66, ethylene ethylacrylate copolymers, ethylene vinyl acetate copolymers, polystyrenes, syndiotactic polypropylenes, polyphenylene sulfides, polyphenylene ethers, polyamides, polyesters, and polycarbonates and the like.

These other polymers can be used, as necessary, either singly, respectively, or in combinations of two or more. The amount of such other polymer mixed in is preferably 100 parts by weight or less, and more preferably 50 parts by weight or less, to 100 parts by weight of the cyclic olefin polymer.

When the amount of the other polymer added is too large, releasability declines and toner sticks.

The cyclic polyolefin used in the present invention can have a charge controlling agent mixed in and the frictional electrostatic charging characteristics thereof controlled. Because the cyclic polyolefin is originally position to the negatively charged side in triboelectric series, it is possible increase the charge amount of the toner and to decrease the amount of reverse charged toner, especially when a negatively charged toner is used. The triboelectric series of materials used as a charge control agent for the cyclic polyolefin can be easily known by frictionally charging them, and measuring the charge polarity (and charge potential) of the cyclic polyolefin with a surface electrometer.

Figure 2:
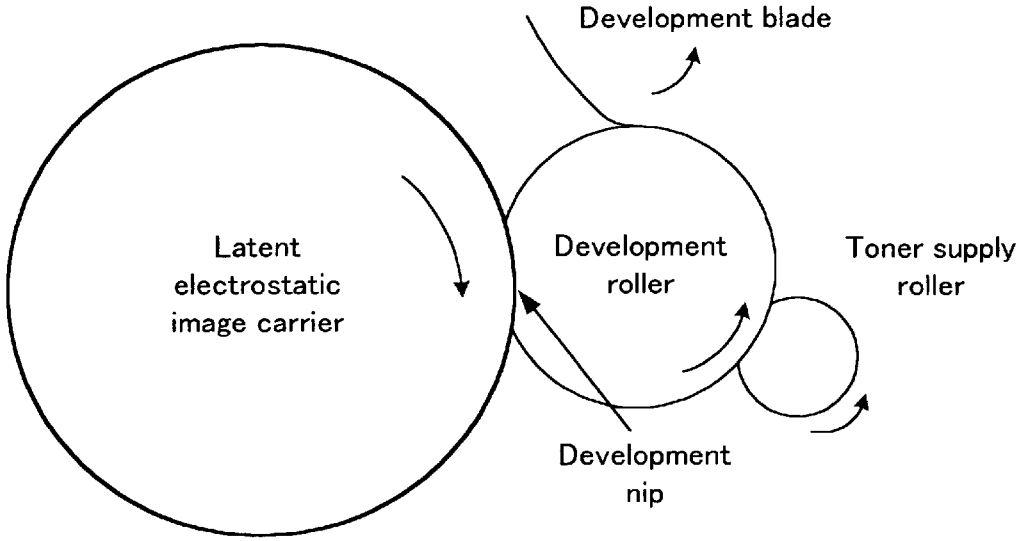
FIG. 2 is a schematic view showing of the developing apparatus of the present invention having development blades.

When the material used is a polymer, for example, this is found out by deploying a developer roller having the cyclic polyolefin provided in the surface thereof in the developing apparatus represented in FIG. 2, effecting sliding-contact turning with a blade on which the material used in the surface is coated or stuck, and measuring the charge polarity (potential) of the developer roller (at which time the toner and other members such as the supply roller are not allowed to make sliding contact with the developer roller). In the case of a powder or liquid, it can be found out by adding the material to the cyclic polyolefin used in the developer roller, deploying that on the blade surface, and measuring the roller charge polarity by the method described earlier.

As to the compounds that can be added, any can be used so long as they are positioned more to the positive charge side in the triboelectric series than the cyclic polyolefin, with a so-called charge controlling agent used in the toner, carrier, and developer roller and the like being preferable.

Specific compounds that may be cited include nigrosine compounds, quaternary ammonium salt compounds, pyridinium salt compounds, triaminotriphenylmethane (Japanese Patent Application Laid-Open No. H2-267565/1990 (published)), metal salts of higher fatty acids, and metal complexes of acetyl acetone and the like, as well as such high-molecular substances as polyamine resins (such as resins cited in Japanese Patent Publication No. S53-13284/1978 (published)), acrylic resins having a quaternary ammonium salt group (such as resins cited in Japanese Patent Application Laid-Open No. S62-210472/1987 (published)), and block polymers of polymers containing a quaternary ammonium salt and lipophilic polymers (such as resins cited in U.S. Pat. No. 4,925,764). Specific examples include "Bontron P-51" (product name) and "Bontron AFPB," made by Orient Chemical Industries, Ltd., "TP-302" (product name) and "TP-415" (product name) made by Hodogaya Chemical Co., Ltd., and "VP SN 4001" (product name) made by Bayer Co., Ltd.

The amount of these charge controlling agents added to 100 parts by weight of the polymer component comprising mainly of the cyclic polyolefin should be from 0.5 to 10 parts by weight. When the amount added is too small, no improvement in the frictional electrostatic charging characteristics can be expected, whereas when too large, a difficulty arises in that the surface releasability declines.

The layer thickness regulating member containing a surface made of a material comprising mainly of the cyclic polyolefin of the present invention is particularly preferably a thin layer roller. The surface layer (the surface layer of the thin layer roller configured of materials comprising mainly of the cyclic polyolefin) can have a suitable electroconductive agent added therein and the volume resistance thereof controlled. As a result, by providing a potential difference between the thin layer roller and the developer roller, the toner frictional electrostatic charging characteristics can be controlled, making it possible in particular to electrically control the generation of reverse charged toner. In that case, by setting the thin layer roller potential more to the − side than the developer roller if a negatively charged toner, and setting the thin layer roller potential more to the + side than the developer roller if a positively charged toner, the reverse charged toner in the toner layer can be held with an electric field by the thin layer roller, and the amount of reverse charged toner in the thin toner layer on the developer roller after passing the place of sliding contact with the thin layer roller can be reduced.

The volume resistance of the surface layer of the thin layer roller is preferably $10^{12}$ Ω·cm or less. If the volume resistance exceeds $10^{12}$ Ω·cm, the effective field holding force of the reverse charged toner drops rapidly.

Controlling the volume resistance of the layer containing the surface comprising mainly of the cyclic polyolefin of the present invention can be done by adding a common charge controlling agent.

Examples of specific materials that may be listed include metal powders such as Ni and Cu, carbon blacks such as furnace black, lamp black, thermal black, acetylene black, and channel black, electroconductive oxides such as tin oxide, zinc oxide, molybdenum oxide, antimony oxide, and potassium titanate, electroless platings made on titanium oxide or mica or the like, and graphite, metal fiber, carbon fiber, and other inorganic fillers and surfactants.

The cyclic polyolefin used in the present invention, can have a compounding agent added therein, as necessary. There is no particular limitation on the compounding agent so long as it is commonly used in the resin industry, and may be, for example, an oxidation inhibitor, UV absorbent, lubricant, anticlouding agent, antifogging agent, plasticizer, pigment, near infrared absorbent, or antistatic agent. These compounding agents can be used singly, respectively, or in combinations of two or more. The amount of the other compounding agent used is selected suitably within a range in which the objects of the present invention are not compromised.

In particular, the coefficient of friction can be stabilized and reduced by adding a polyethylene wax. The effectiveness of waxes in general, but polyethylene wax in particular, in reducing the surface coefficient of friction is great, but they have shortcomings, such as being poorly miscible with general-purpose resins, with a concentration distribution oriented in the thickness direction of the surface layer, so that the coefficient of friction increases very rapidly when the outermost surface is worn away.

In that regard, the cyclic polyolefin used in the present invention exhibits great affinity with polyethylene wax, with but small concentration distribution in the surface layer thickness direction, wherefore the coefficient of friction is stable over time.

Polyethylene waxes are 500 to 10,000 ethylene polymers, generally classified into emulsion waxes having a polar group and non-emulsion waxes having no polar group. Either can be used in the present invention. These are readily available, being marketed by such manufacturers as Mitsui Petrochemical Industries, Ltd. (High Wax), Sanyo Chemical Industries, Ltd. (Sun Wax), Mitsubishi Chemical Corporation (Daiyaren), Hochster Porzellan (Hochster Wax), and BASF (A-Wax).

The amount of such polyethylene waxes added to 100 parts by weight of the polymer mainly comprising of the cyclic polyolefin should be from 0.01 to 5 parts by weight. When that added amount is too small, no effect in reducing the coefficient of friction is seen, whereas when too large, a difficulty arises in that surface releasability declines.

A description is given next of the configuration of the layer thickness regulating member of the present invention. It is only necessary that the layer thickness regulating member of the present invention be such that at least the surface thereof is formed primarily of at least one of a nylon resin containing a crosslinked alkylalkoxy group and cyclic polyolefin, and there is no limitation on the layer configuration. For example, a sheet or belt can be molded of a catalyst- or crosslinking agent-added nylon resin containing an alkylalkoxy group or cyclic polyolefin alone and used as the layer thickness regulating member 21. Most commonly, a surface layer is formed by a coating process on the surface of a sheet, roller, or belt or the like made of a metal such as SUS, copper, or Al, or a polymer, and used.

When the developer bearing member 20 is of a material that lacks flexibility, such as a metal or hard plastic or the like, the layer thickness regulating member of the present invention should have a material comprising mainly of one of a nylon resin containing the alkylalkoxy group and cyclic polyolefin on an elastic layer. That is because, by the layer thickness regulating member having flexibility, it can readily follow the irregularities in the toner layer on the rigid developer bearing member 20, and a thin layer can be obtained that is uniform and smooth. Also, because the layer mainly comprising of a nylon resin containing the alkylalkoxy group or cyclic polyolefin of the present invention exhibits adequate flexibility, there is no worry about fracturing or the like in the surface layer. The rubber hardness of the elastic layer should preferably be 80 degrees (JISA) or less, and the thickness of the elastic layer from 100 μm to 10 mm. When a crosslinking agent is added to the nylon resin having the methylmethoxyl group, and crosslinking is effected, the amount thereof added should be 30 parts by weight or less. When the amount added exceeds 30 parts by weight, nylon resin flexibility is lost and fracturing occurs.

Typical rubbers and thermoplastic elastomers can be used as a material for the elastic layer. That is, those which may be cited include diene rubbers such as styrene butadiene rubber (SBR), butadiene rubber (BR), isoprene rubber (IR), nitrile butadiene rubber (NBR), nitrile isoprene rubber (NIR), chloroprene rubber (CR), olefin rubbers such as butyl rubber (IIR), ethylene propylene rubber (EPM, EPDM), and chlorosulfonated polyethylene &60, ether rubbers such as olefin rubber, and epichlorohydrine rubber (CHR, CHC), and other rubbers such as silicon rubbers, fluorine rubbers, acrylic rubbers, and urethane rubbers, as well as elastomer materials such as styrene-based, olefin-based, polyvinyl chloride-based, urethane-based, polyester-based, polyamide-based, fluorine-based, and polyethylene chloride-based thermoplastic elastomers.

It is also possible to add an electroconductive agent to these materials to impart electroconductivity. In such cases, it is possible to use the electroconductive agents noted earlier, but it is also possible to blend a commonly known epichlorohydrine rubber or nitrile butadiene rubber or the like as a low resistance rubber material and lower the resistance.

Next, a description is given for a method of manufacturing the layer thickness regulating member 21 using an elastic roller as a typical example. An elastic layer is molded onto an electroconductive core metal (metal such as SUS or Al or the like, or an electroconductive resin), by a common molding method such as extrusion molding, injection molding, press molding, or vapor vulcanization. In this case, in order to enhance the binding force and adhesive force between the electroconductive core metal and the electroconductive layer, it is possible to use a primer beforehand between the layers. Next, after grinding the surface of the electroconductive layer to the prescribed layer thickness, the nylon resin having the methylmethoxyl group of the present invention is molded. The nylon is thoroughly dissolved in a lower alcohol such as methanol or ethanol, into which the crosslinking agent noted earlier is mixed in, in a prescribed amount, and stirred. This coating liquid is coated on by a method noted earlier, hardened under prescribed conditions, and dried. After hardening, it is permissible to grind the surface as necessary.

A description is given next of a method of manufacturing the thin layer roller-type layer thickness regulating member in which a material mainly comprising of an cyclic polyolefin as another typical example.

The molding can be done by an ordinary method and use can be made, for example, of fusion melting or a coating process after dissolving the components in a solvent.

When the thin layer roller is fabricated by a fusion molding process, there are a number of methods used, including fusion extrusion methods such as an inflation method, as well as calender methods, hot press methods, and injection molding methods.

The conditions for the fusion molding are suitably selected according to the molding method used. With a fusion molding method, for example, the resin temperature is suitably selected within a range of the glass transition temperature or higher to the decomposition temperature or lower, but usually within a range of from 100 to 400° C., preferably from 150 to 350° C., and more preferably from 200 to 300° C. The temperature of the draw-off roll is usually within a range of from 0 to 200° C., but preferably from 30 to 180° C., and more preferably from 50 to 150° C.

When the thin layer roller is fabricated after dissolving the components in a solvent, that can be done according to an ordinary method, and use can be made, for example, of a method wherein the components are dissolved or dispersed in a solvent, that liquid-form composition is cast on a suitable carrier (support material), and then the solvent is removed by drying.

There is no particular limitation on the carrier used, and any that is employed in ordinary solution casting can be used. Citable examples include rollers made of a metal like SUS or Al, electroconductive resin rollers, and rubber rollers.

The solvents that can be used include, for example, aromatic hydrocarbons such as benzene, toluene, and xylene, alicyclic hydrocarbons such as cyclohexane, esters such as butyl acetate, ethers such as tetrahydrofurane and dimethoxyethane, alcohols such as methanol, ethanol, and isopropanol, ketones such as methylethyl ketones, and halide solvents such as methylene chloride, chloroform, carbon tetrachloride, and ethyl dichloride.

These solvents can be used singly, respectively, or in combinations of two or more. The concentration of the cyclic olefin-based polymer in the solvent is suitably selected according to the thickness of the film being made, but is usually within a range of from 0.1 to 60 wt. %, but preferably of from 1 to 50 wt. %, and more preferably of from 5 to 45 wt. %. When the concentration of the cyclic olefin-based polymer is within such a range, it is easy to regulate the film thickness and outstanding film-fabricating qualities are exhibited.

There is no particular limitation on the method used to cast the liquid-form composition onto a carrier, and this can be done, for example, using a doctor knife, Meyer bar, or roll coating or the like. The casting of the liquid composition can be performed by coating it by spraying, brushing, rolling, spin-coating, or dipping or the like. If the desired film thickness is not obtained by one coating, coating can be done repeatedly.

In the thin layer roller as described above, the lower layer configuration can be variously formed as necessary. Besides deploying an elastic layer as described earlier or the like, it is possible to deploy an adhesive layer or the like at the interface in order to improve the bonding properties with the lower layer.

Another aspect of the developing apparatus of the present invention is a developing apparatus that supplies developer to the latent electrostatic image, makes that latent electrostatic image visible, and forms a developed image, comprising a developer bearing member capable of carrying developer on the surface thereof, and a layer thickness regulating member for regulating the developer carried on that developer bearing member to a uniform thickness, wherein at least the surface in the developer bearing member is formed of a material comprising mainly of a polyimide denatured silicone resin.

The polyimide denatured silicone resin used at least in the surface of the developer bearing member of the developing apparatus can be expressed by the general formula given below.

[Formula 1]

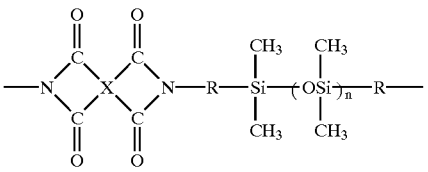

(where, X is a quadrivalent aromatic cyclic group or aliphatic cyclic group, R is a bivalent organic group, and n is an integer 5 or greater.)

Polyimides are generally known as rigid resins of high strength, but they are given pliability by introducing a siloxane structure in the main chain, whereupon the advantage of enhanced releasability is also realized. Accordingly, by having the material described above contained in at least the surface, it is possible to obtain satisfactory wear resistance and toner releasability in the developer roller.

Such polyimide denatured silicone resins can be manufactured from raw material comprising of a mixture of siloxane diamine, aromatic diamine, and tetracarboxylic dianhydride.

The siloxane amine compound is represented by the general formula below.

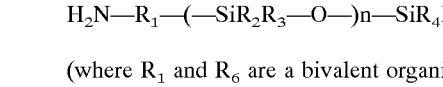

$$H_2N—R_1—(—SiR_2R_3—O—)n—SiR_4R_5—R_6NH_2$$

(where $R_1$ and $R_6$ are a bivalent organic group, $R_2$ to $R_5$ are alkyl groups, phenyl groups, or substitution phenyl groups, and n is an integer from 5 to 50), and specific citable examples whereof are bis(3-aminopropyl) tetramethyl disiloxane, bis(10-aminodecamethylene) tetramethyl disiloxane, dimethyl siloxane tetramers or octamers having aminopropyl end groups, and bis(3-aminophenoxymethyl)tetramethyl disiloxane and the like.

The aromatic diamines used in the present invention which may be cited include aromatic diamines containing mainly "an aromatic diamine compound having 2 or more, and particularly from 2 to 5, aromatic rings (such as benzene rings)" such as (1) biphenyl diamine compounds, diphenylether diamine compounds, benzophenone diamine compounds, diphenylsulfone diamine compounds, diphenylmethane diamine compounds, diphenylmethane diamine compounds such as 2,2-bis(phenyl)propane, 2,2-bis(phenyl) hexafluoropropane diamine compounds, and diphenylenesulfone diamine compounds, (2) di(phenoxy) benzene diamine compounds and di(phenyl)benzene diamine compounds, and (3) di(phenoxyphenyl)hexafluoropropane diamine compounds, bis(phenoxyphenyl)propane diamine compounds, which can be used singly, respectively, or in a mixture.

For the aromatic diamines noted above, those which can be particularly cited include diphenylethyl diamine compounds such as 1,4-diaminodiphenyl ether and 1,3-diaminodiphenyl ether, di(phenoxy)benzene diamine compounds such as 1,3-di(4-aminophenoxy)benzene and 1,4-bis (4-aminophenoxy)benzene, and bis(phenoxyphenyl) propane diamine compounds such as 2,2-bis(4-(4-aminophenoxy) phenyl)propane and 2,2-bis(4-(3-aminophenoxy)phenyl) propane.

Next, the following specific examples of tetracarboxylic dianhydrides used in the present invention can be cited, namely pyromellitic dianhydride, 3,3',4,4'-diphenylsulfone tetracarboxylic dianhydride, 3,3',4,4'-benzophenone tetracarboxylic dianhydride, 3,3',4,4'-biphenyl tetracarboxylic dianhydride, 2,3',3,4'-biphenyl tetracarboxylic dianhydride, bis(3,4-dicarboxydiphenyl)ether dianhydride, 4,4'-bis(3,4-dicarboxyphenoxy)diphenylsulfone dianhydride, ethylene glycol bistrimellitic dianhydride, 2,2-bis[4-(3,4-dicarboxyphenoxy)phenyl]propane dianhydride, ',4,4'-diphenylsulfone tetracarboxylic dianhydride, 3,3',4,4'-biphenyl tetracarboxylic dianhydride, and 2,3',3,4'-biphenyl tetracarboxylic dianhydride.

The polyimide denatured silicone resin used in the present invention can be manufactured by a commonly known method using the compounds cited above. Such methods include, for example, the method of heating those compounds in an organic solvent, in the presence of a catalyst such as a tributylamine, triethylamine, or triphenyl phosphite, as necessary, to obtain a polyimide directly, the method of first causing the tetracarboxylic dianhydride to react with a diamine in an organic solvent to obtain a polyamic acid that is a polyimide precursor, and then adding a dehydration catalyst such as p-toluene sulfonic acid, as necessary, and heating to make an imide and obtain the polyimide, and the method of taking that poliamic acid and adding thereto an acid anhydride such as anhydrous acetic acid, anhydrous propionic acid, or anhydrous benzoic acid, a dehydration ring-closing agent such as a carbodiimide compound such as dicyclohexyl-carbodiimide, and, as necessary, a ring-closing catalyst such as pyridine, isoquinoline, imidazol, or triethylamine, and effecting chemical ring closure.

It is only necessary that the developer roller of the present invention be configured with a polyimide denatured silicone resin at least in the surface thereof, which can be used mixed with another organic or inorganic material as suitable and necessary. Examples thereof are now specifically described.

Figure 3:
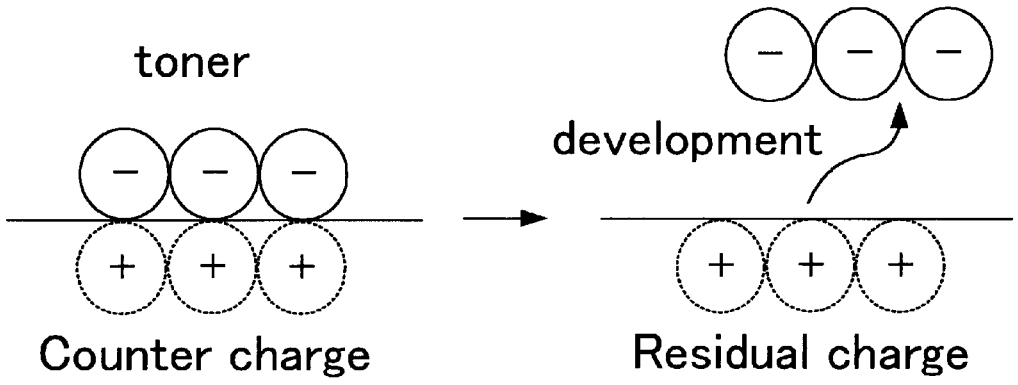
FIG. 3 is a view for explaining toner behavior.

By making the developer roller of the present invention electroconductive by adding a resitance control agent, the frictional electrostatic charging charge remaining in the vicinity of the developer roller surface can be quickly dissipated. In FIG. 3, the case of a negatively charged toner is illustrated as an example. In this case, the opposing charge generated by the frictional electrostatic charging with the toner remains in the vicinity of the surface of the developer roller after toner developing. If this charge continues to remain until the next developing, it shows up as a (negative) afterimage. In order to eliminate this residual charge, there are means wherein a decharging member is made to contact the surface of the developer roller and leak off the residual charge, but there are difficulties therewith in that the thin toner layer or surface layer is adversely worn.

According to the present invention, it is preferable, in view of enabling the easy dissipation of the residual charge and preventing the occurrence of afterimages, that the volume resistance of the surface layer of the developer roller containing the polyimide denatured silicone resin is made $10^{12}$ Ω·cm or lower. When the volume resistance is too high, the residual charge is not rapidly dissipated, and afterimages occur.

For the resistance controlling agent used in the developer roller of the present invention, a common ordinary agent can be used. To cite specific examples, use can be made of organic antistatic agents and the like such as carbon blacks such as Ketjenblack or acetylene black, fine metal powders such as Ni powder, and materials such as metal oxides such as titanium oxide and zinc oxide, or organic compounds or polymers containing a quaternary ammonium salt group, carboxylic acid group, sulfonic acid group, sulfuric acid ester group, or phosphoric acid ester group of the like, or compounds or polymer compounds having an electroconductive unit typified by ether ester amide or ether amidoimide polymers, ethylene oxide-epihalohydrine copolymers, and methoxypolyethylene glycol acrylates and the like.

In the developer roller of of the developing apparatus according to the present invention, the toner electrostatic charging characteristics can be improved by adding a charge controlling agent compatible with the electrostatic charging polarity of the toner. For the charge controlling agent used in positively charged toners, for example, there are metal complex dyes typified by azo-chromium complex dyes, hydroxy benzoic acid derivitaves or aromatic dicarboxylic acid, metal salt compounds or metal complex compounds of anthranilic acid derivatives, organic boron compounds and phenol compounds or oligomer types.

The polyimide denatured silicone resin used in the present invention is positioned slightly toward negative electrostatic charging in the triboelectric series due to the fact that a siloxane component is contained in the structure thereof. Accordingly, when a negatively charged toner is used, it is particularly effective to add a positive electrostatic charging charge controlling agent to increase the toner electrostatic charging. By a positive electrostatic charging charge controlling agent is meant to be positioned toward positive electrostatic charging in the triboelectric series relative to the polyimide denatured silicone resin; the triboelectric series frictionally electrify both, and the charge polarity (and charge potential) of the polyimide denatured silicone can be readily learned by measurement with a surface electrometer.

Figure 6:
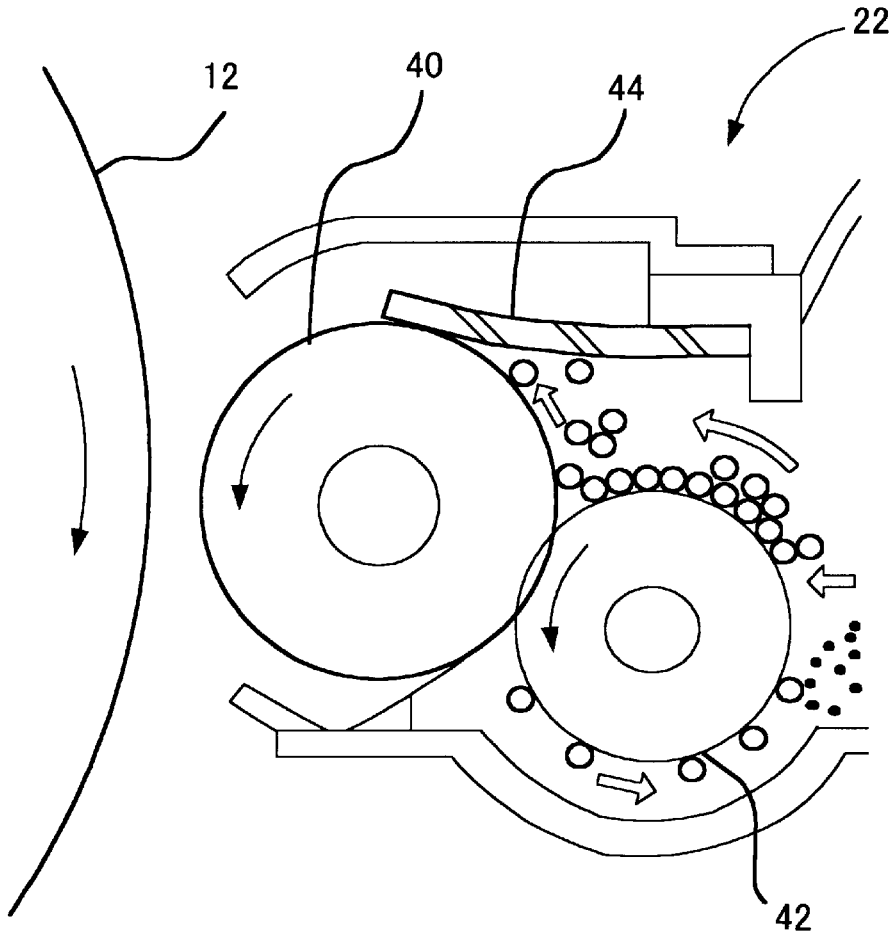
FIG. 6 is a schematic view of an electrophotographic apparatus relating to this embodiment.

When the material used is a polymer, for example, a roller wherein the polyimide denatured silicone resin is provided in the surface is deployed in the developing apparatus represented in FIG. 6, sliding-contact turning is caused with a blade to the surface whereof the material used has been coated or stuck on, and the charge polarity (potential) of the roller is known by measuring it (at which time other members are not made to slide-contact the developer roller, such as the supply roller). Moreover, in the case of a powder or liquid, the material is added to the cyclic polyolefin used in the developer roller, deployed in the blade surface, and then, as with the method described above, the roller charge polarity can be learned by measuring it. Examples of charge controlling agents used for negatively charged toners used optimally include azine dyes typified by nigrosine, basic dyes typified by triphenyl methane dyes, basic dye lake pigments, and metal complex dyes wherein a residual quaternary ammonium group has been introduced in the mother skeleton, and the like.

Particularly preferable additives include such as the maleimide resins containing a quaternary ammonium salt group and methacrylimide resins containing a quaternary ammonium salt group indicated in the following representative example.

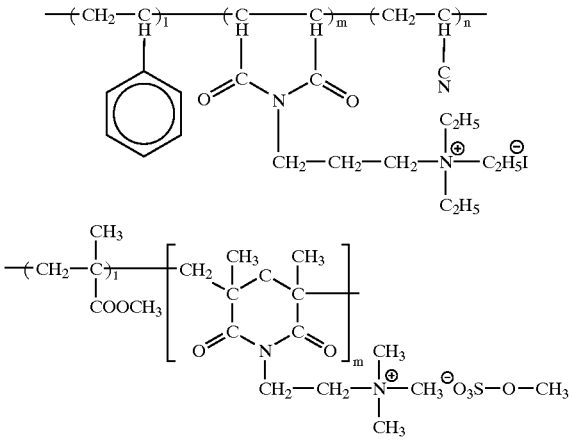

Not only do these additives exhibit outstanding positive electrostatic charging due to containing quaternary ammonium, but also exhibit the characteristic of the electric properties being electroconductive. Also, because these are imide materials like the polyimide denatured silicone resin used in the present invention, they exhibit affinity therewith and can be used optimally as organic charge electroconductive agents. By using these materials, electroconductivity can be controlled uniformly without variation in resistance.

The amount of the material noted above added should be 15 parts by mass or greater to 100 parts by mass of the polyimide denatured silicone resin. When the added amount is too small, the resistance does not adequately decline.

In the layer containing the polyimide denatured silicone resin at least in the present invention, besides the resistance controlling agent and charge controlling agent, various organic or inorganic materials can be used mixed in as necessary.

Other organic resin materials that can be mixed in include such as alkyd resins, polyether chloride, polyethylene chloride, epoxy resins, fluorine resins, phenol resins, poliamides, polycarbonates, polyethylenes, methacrylic resins, polypropylenes, polystyrene resins, polyurethane, vinyl polychloride, vinylidene polychloride, and silicone resins. These can be used dissolved in a solvent, or having one or the other mixed in in a fine resin particle condition.

A description is given next of the developer roller 40 of the developing apparatus that is one embodiment of the present invention.

Figure 4:
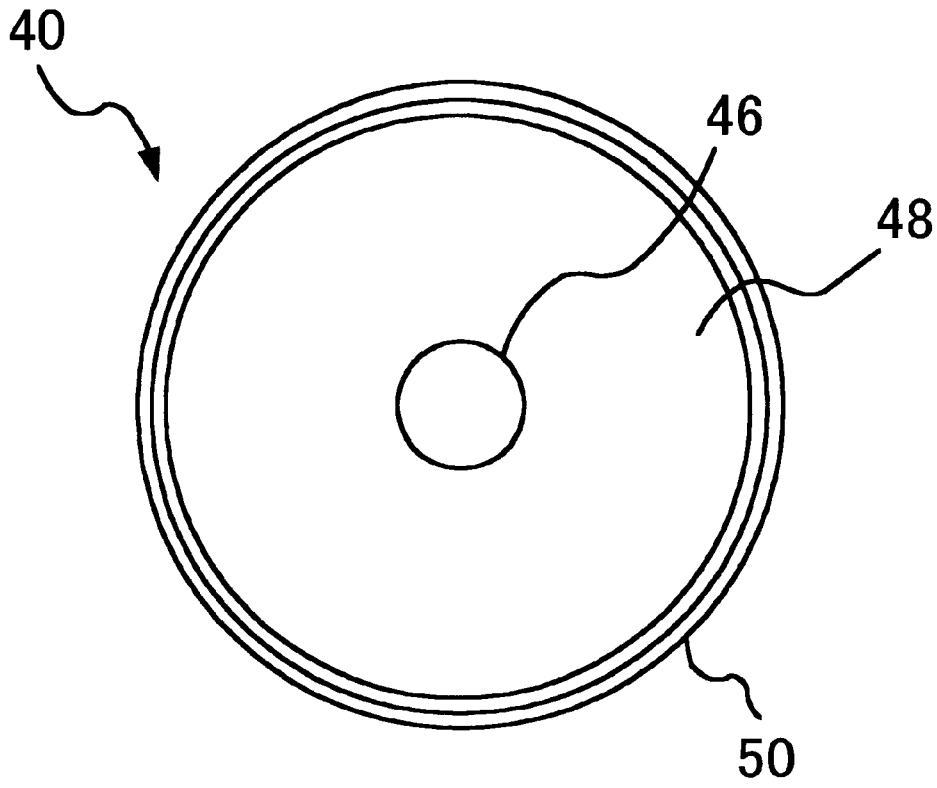
FIG. 4 is a schematic view showing one example of the configuration relating to an embodiment of a developer roller of the present invention.
Figure 5:
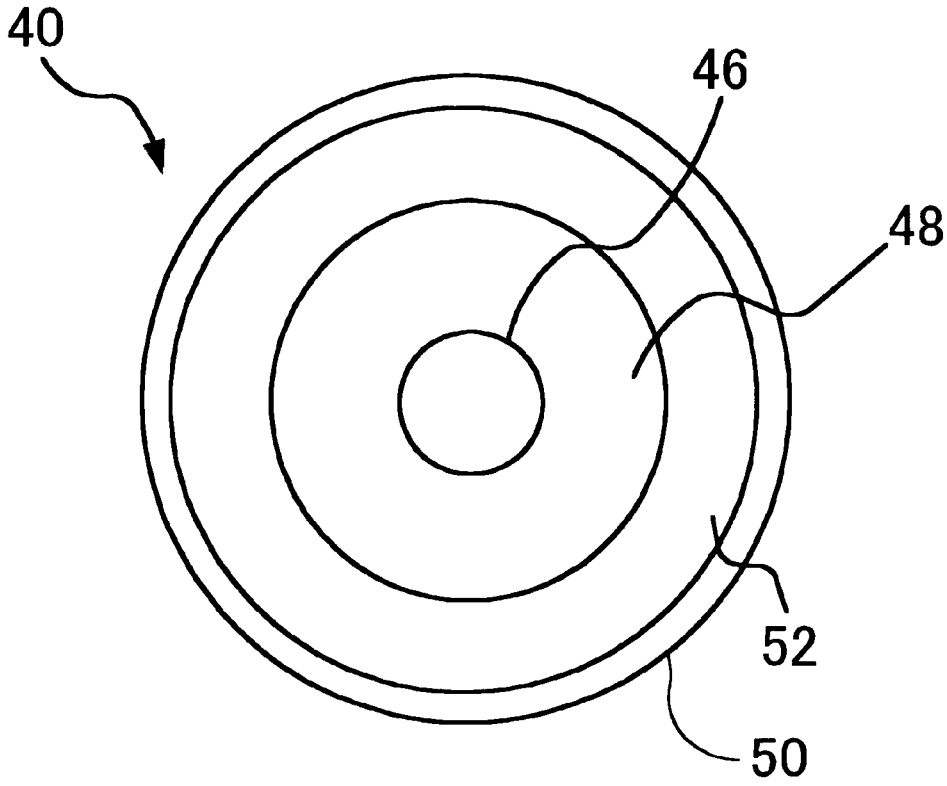
FIG. 5 is a schematic view of another example of the part of a developer roller of the developing apparatus according to the present invention.

FIG. 4 represents an example wherein a surface layer 50 of the developer bearing member made of a material mainly comprising of the polyimide denatured silicone according to the present invention is deployed on an electroconductive support material (the shaft indicated by the reference symbol 46 and the core metal indicated by the reference symbol 48) of which a metal such as Al or SUS is typical. FIG. 5 represents an example wherein an elastic layer 52 is further provided on the core metal 48, and the surface layer 50 of the present invention is deployed on top of that elastic layer 52. The electroconductive support material used may be of a hollow structure to reduce the weight thereof.

It is possible for the developer roller 40 described above to have a special functional layer such as an oil-resistant layer or adhesive layer or the like deployed between the layers as necessary.

The elastic layer material used may be a common one.

More specifically, use can be made of a polyurethane, butyl rubber, nitrile rubber, epichlorohydrine rubber, polyisoprene rubber, polybutadiene rubber, silicone rubber, fluorine rubber, styrene-butadiene rubber, ethylene-propylene rubber, ethylene-propylene-diene rubber, chloroprene rubber, acrylic rubber, or a mixture thereof or the like. With some exceptions, these rubber materials normally are insulative, but, as noted earlier, when a bias voltage is imparted, they can be used after being made electroconductive by the addition of one of the resistance controlling agents noted earlier.

A description is given next of a method for manufacturing the developer roller of the developing apparatus according to one embodiment of the present invention.

[Electroconductive Layer Molding Method]

In molding the developer roller as described above, a method is used such as a press molding process wherein the electroconductive support material and rubber composition for forming the elastic layer are simultaneously heated and subjected to pressure inside a dye, an extrusion molding process wherein the electroconductive support material and rubber composition are integrally extruded by an extruder using a cross-head, and then subjected to primary vulcanization in either a gear oven or infrared oven, or an injection molding process wherein the electroconductive support material is first set inside a molding dye and then the composition noted earlier is injected into that dye and heating is performed, and the surface can be ground as necessary.

[Method of Dissolving Polyimide Denatured Silicone Resin in Solvent and Effecting Coating Molding]

When the developer roller is fabricated after dissolving the polyimide denatured silicone resin in the solvent, that can be done according to a conventional method. It can be done, for example, by taking a liquid composition made by dissolving or dispersing the components noted earlier in a solvent, casting that on a suitable carrier (support material), and then removing the solvent by drying.

There is no particular limitation on the carrier, and one that is used in an ordinary solution casting process is used. Citable examples include rollers made of a metal like SUS or Al, electroconductive resin rollers, and rubber rollers and the like.

For the solvent, examples such as N-methyl-2-pyrrolidone, N, N-dimethylacetoamide, N, N-dimethylformamide, dimethylsulfoxide, sulfolane, hexamethyl triamide phosphate, 1,3-dimethyl-2-imidazolidone, hexane, benzene, toluene, xylene, methylethyl ketone, acetone, diethyl ether, tetrahydrofurane, dioxane, 1,2-dimethoxymethane, diethylene glycol dimethyl ether, methyl cellosolve, cellosolve acetate, methanol, ethanol, propanol, isopropanol, methyl acetate, ethyl acetate, acetonitrile, methylene chloride, and trichloroethane may be cited. In using these, the types and amounts are suitably selected so that the components will dissolve and/or disperse.

The concentration of the polyimide denatured silicone resin in the solvent is suitably selected according to the thickness of the film to be fabricated, but will usually be within a range of 0.1 to 60 mass %, but preferably 1 to 50 mass %, and more preferably 5 to 45 mass %. When the polyimide denatured silicone resin concentration is within such a range, it is easy to regulate the film thickness and outstanding film-fabricating qualities are exhibited.

For the method for casting the liquid composition on the carrier, although there is no particular limitation thereon, such can be done using a doctor knife, Meyer bar, or roll coating or the like, for example. The casting of the liquid composition can be done by coating by spraying, brushing, rolling, spin coating, or dipping or the like. If the desired film thickness is not obtained by one coating, coating can be done repeatedly.

Next, the internal configuration of the developing apparatus 22 according to the present invention is described further with reference to FIG. 6. The internal configuration of the developing apparatus 22 is described further with reference to FIG. 6. FIG. 6 represents the apparatus shown in FIG. 7 as seen from the back side of the paper.

Toner is sent by an agitator (not shown) to the developer roller 40 side. That is, the toner moves as indicated by the thick hollow arrows in FIG. 6, moving to a toner pool formed where a supply roller 42 and developer roller 40 are pressed together. The supply roller 42 turns by contact with the developer roller 40, and thereby frictionally charges the toner, and the charged toner is carried onto the developer roller 40, and moves to the thin layer restricting member (carrying thickness restricting member) 44. Then, with the turning of the developer roller 40, the thin layer restricting member 44 makes contact with the developer roller 40, and the toner is formed to an appropriate uniform toner layer thickness (carrying thickness) and conveyed to the developing region. Developing is then performed by causing the toner to be transferred to the photo-sensitive member drum 12 whereon a latent image has been written by the exposure unit (image exposure unit 20) noted earlier.

In FIG. 6, the photo-sensitive member drum 12 and developer roller 40 are in a non-contacting condition, but it is also possible to perform developing with those two members in contact. In that case, the developing region is generally secured by doing things like making the photo-sensitive member a belt shape instead of a drum, using an elastic member in the developer roller, making one or the other, or both, a flexible structure or material exhibiting flexibility and capable of being bent and deformed.

It is preferable that the supply roller 42 have the surface thereof formed by an elastic foam member. For this elastic foam member, polyurethane foam having a cell diameter of 50 $\mu$m and Askar hardness of 30° can be used. It is also possible to add carbon black or the like to effect electroconductivity, in which case the toner suppliability to the developer roller 40 and electrostatic charging characteristics and the like can be controlled by forming a bias electric field with the developer roller 40.

A detailed description of an electrophotographic apparatus wherein the developing apparatus of the present invention is used is described next with reference to the drawings.

The image forming apparatus of the present invention is an apparatus having a latent electrostatic image carrier, charging means for electrically charging the latent electrostatic image carrier, photoexposure means for performing photoexposure in an image manner on the latent electrostatic image carrier charged by the electrostatic charging means and forming latent electrostatic images, developing means for supplying the developer to the latent electrostatic images, making the latent electrostatic images visible, and forming developed images, and transfer means for transferring the developed images to a recording medium, wherein the developing means are the developing apparatus of the present invention described in the foregoing, and the developer bearing member in that developing apparatus is deployed in opposition to the latent electrostatic image carrier.

FIG. 2 is a schematic view for describing the electrophotographic apparatus of the present invention, and the modification examples noted below also belong to the category of the present invention.

In FIG. 2, this electrophotographic apparatus has a decharging exposure unit 2, electrostatic charging charger 3, eraser 4, image exposure unit 5, developing unit 6, pre-transfer charger 7, transfer charger 10, separation charger 11, separation pawl 12, pre-cleaning charger 13, fur brush 14, and cleaning brush 15 deployed, counterclockwise in that order, about the circumference and close to the upper surface of a drum-shaped photo-sensitive member 1. Resist rollers 8 are also deployed for feeding transfer paper 9 in between the photo-sensitive member 1, transfer charger 10, and separation charger 11. The photo-sensitive member 1 comprises a drum-form electroconductive support material and a photoconductive layer bonded to the upper surface thereof, and turns in the counterclockwise direction.

In a electrophotographic method wherein the electrophotographic apparatus described above is used, the photo-sensitive member 1 turns in the counterclockwise direction, and is given a negative (or positive) charge by the electrostatic charging charger 3, and a latent electrostatic image is formed on the photo-sensitive member 1.

The developer bearing member 20 in the developing apparatus of the present invention is deployed in opposition to the photo-sensitive member in either a contacting or non-contacting condition, toner 24 is transferred from the developer bearing member 20 onto the latent electrostatic image in the developing region 26, and developed, whereupon the latent image is made a visible image.

Figure 7:
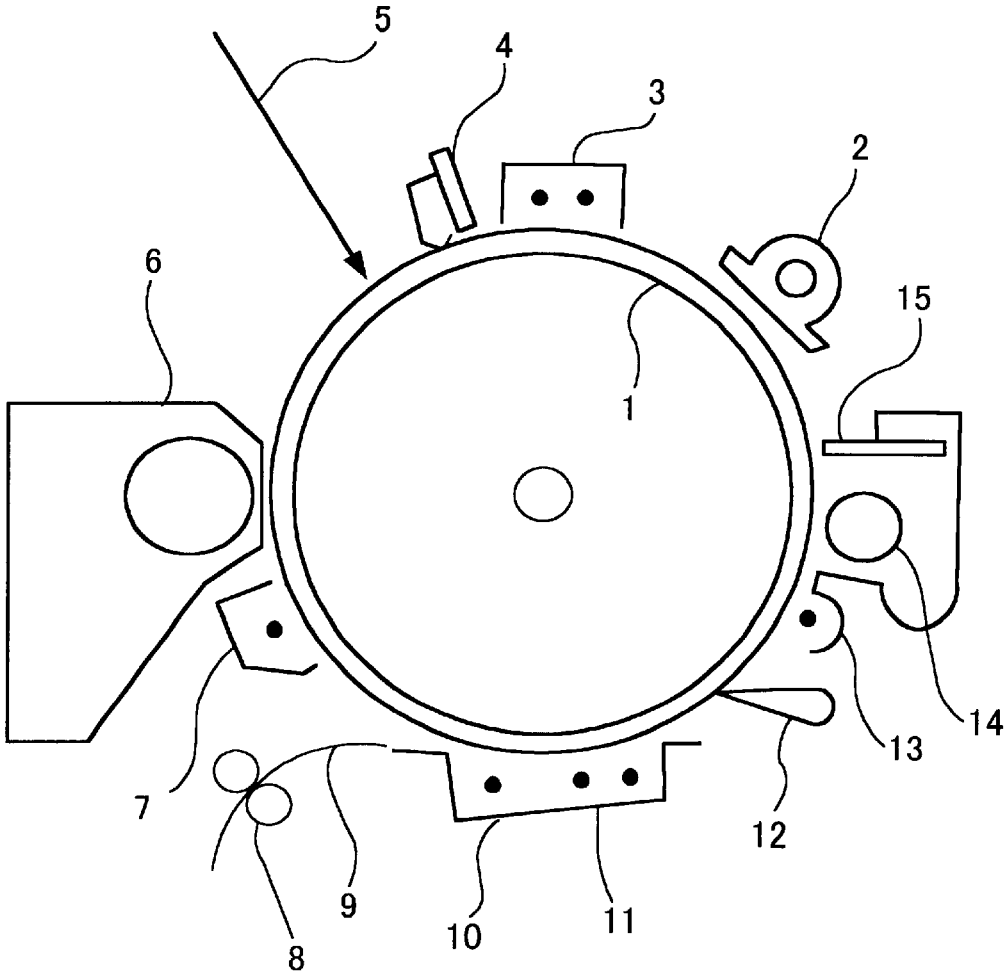
FIG. 7 is a schematic view showing an example of the electrophotographic apparatus of the present invention.

In general, the charger described above can be used in the transfer means, but that which is used both as a transfer charger and separation charger, as shown in FIG. 7, is effective.

Also, for the light source used in the image exposure unit 5 and decharging exposure unit 2 and the like, a light emitter such as a fluorescent lamp, tungsten lamp, halogen lamp, mercury lamp, sodium lamp, light emitting diode (LED), semiconductor laser (LD), or electroluminence (EL) device can be used. In order to irradiate with only light within a desired wavelength region, moreover, any of various filters such as a sharp cut filter, band pass filter, near infrared cut filter, dichroic filter, interference filter, or color-temperature conversion filter can be used. Such light source or the like can be used also when light is irradiated on the photo-sensitive member if, besides the image exposure process and dcharging process, a transfer process, cleaning process, or process such as pre-exposure or the like that also serves for light irradiation is deployed.

In the developing apparatus 6, toner is made to adhere to the photo-sensitive member 1, the latent electrostatic image is developed, and the electrostatic charging condition of the toner image is adjusted by the pre-transfer charger 7, then the toner image is transferred to the transfer paper 9 by the transfer charger 10, the electrostatically adhering state between the photo-sensitive member 1 and the transfer paper 9 is eliminated by the separation charger 11, and the transfer paper 9 is separated from the photo-sensitive member 1 by the separation pawl 12. After the transfer paper 9 is separated, the surface of the photo-sensitive member 1 is cleaned by the pre-cleaning charger 13, fur brush 14, and cleaning brush 15. This cleaning can also be performed by removing the remaining toner with the cleaning brush 15 alone.

When image exposure is conducted by subjecting the photo-sensitive member to negative or positive electrostatic charging, a negative or positive latent electrostatic image is formed on the photo-sensitive member. If this is developed with a toner (fine electrodectecting particles) that has been given a positive or negative charge, a positive image is obtained, whereas, conversely, if developed with a toner given a negative or positive charge, a negative image is obtained. A commonly known method can be applied in such developing means, and a commonly known method is used also in the deelectrostatic charging means.

In this example, a drum shape is indicted for the photo-sensitive member, but a sheet or endless belt form can also be used. Depending thereon, the contact method (contact or non-contact) of the developer roller in the developing apparatus can be suitably selected, and the layer thickness regulating member can also be selected according thereto as described earlier.

Such image forming means of the present invention as described in the foregoing may be securely incorporated inside an apparatus such as a copier apparatus, fax machine, or printer or the like, but may also be incorporated in such apparatuses in the form of a process cartridge. By process cartridge is meant a single apparatus (part) that has a photo-sensitive member built therein and also comprises electrostatic charging means, exposure means, developing means, transfer means, cleaning means, and delectrostatic charging means. The process cartridge can take a variety of shapes, and a typical example of such shapes is shown in FIG. 8.

Figure 8:
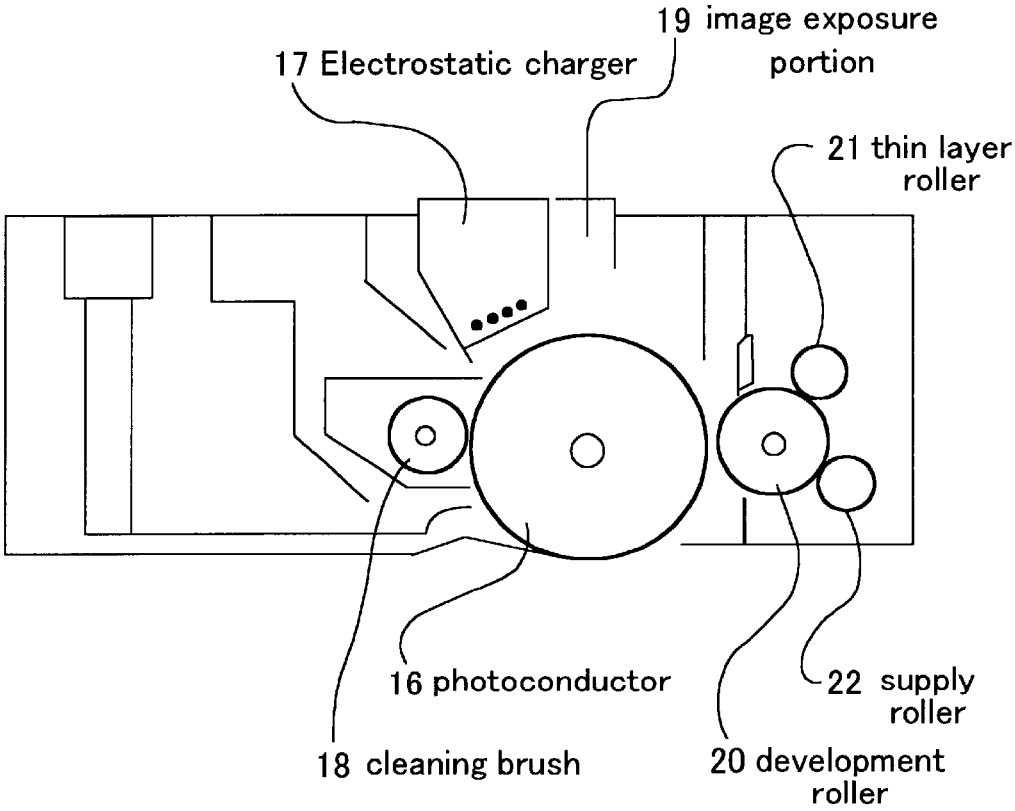
FIG. 8 is a schematic view of one example structure for when an image forming apparatus relating to the present invention is formed as a process cartridge.
Figure 9:
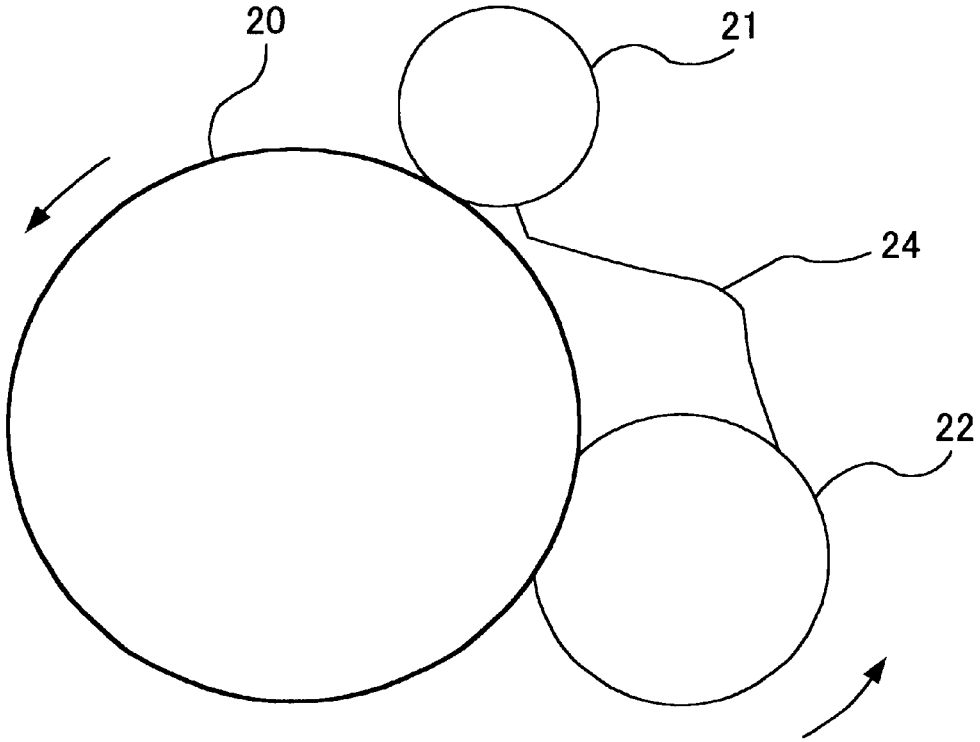
FIG. 9 is a schematic view of an example of the configuration relating an embodiment of the developing apparatus of the present invention.

The process cartridge shown in FIG. 8 has a compact structure comprising an electrostatic charging charger 17, cleaning brush 18, image exposure unit 19, developer roller 20, thin layer roller 21, and supply roller 22 and the like deployed about the periphery of a photo-sensitive member 16.

When image exposure is conducted by subjecting the photo-sensitive member 12 to negative or positive) electrostatic charging, a negative or positive latent electrostatic image is formed on the photo-sensitive member 12. If this is developed with a toner (fine electrodectecting particles) that has been given a positive or negative charge, a positive image is obtained, whereas, conversely, if developed with a toner given a negative (or positive) charge, a negative image is obtained. A commonly known method can be applied in such developing means, and a commonly known method is used also in the deelectrostatic charging means.

For the pre-cleaning charger, use can be made of any commonly known electrostatic charging means, beginning with a corotron, scorotron, solid state charger, and charging roller and the like. For the transfer charger and separation charger, moreover, usually the electrostatic charging means noted above can be used, and a charger wherein a transfer charger and separation charger are integrated is effective and preferable. For the cleaning brush, use can be made of any known brush, beginning with a fur brush or magnetic fur brush or the like.

EXAMPLES

Descriptions are given next using embodiments. In terms of a developing apparatus wherein at least the surface of the layer thickness regulating member is formed of a material comprising mainly of a crosslinked nylon resin containing an alkylalcoxyl group, the present invention is specifically described by working examples, but the present invention is not limited by these examples.

Examples A-1 to A-6, Comparative Examples A-1, A-2

Layer Thickness Restriction Member Formula:

A coating liquid was fabricated based on the following table.

TABLE 10

| example/ comparative example | ex. 1 | ex. 2 | ex. 3 | ex. 4 | ex. 5 | ex. 6 | comp. ex. 1 | comp. ex. 2 |
|---|---|---|---|---|---|---|---|---|
| material | | | | | | | | |
| 6-nylon containing methyl-methoxyl group *1 | 100 | | 100 | 100 | | 100 | 100 | |
| 12-nylon containing methyl-methoxyl group *2 | | 100 | | | 100 | | | 100 |
| citric acid | 3 | 3 | | | | | | |
| tartaric acid | | | 3 | | | | | |
| silane coupling agent *3 | | | | 5 | 5 | | | |
| melamine resin *4 | | | | | | 100 | | |
| | | | (parts by weight) | | | | | |

Note 1)
silane coupling agent:
*1 FR101: manufactured by Namariichi Corporation
*2 FR301: manufactured by Namariichi Corporation
*3 SZ6070: CH3Si (OCH3)3: Torey Silicone Corporation
*4 Super Bekkamin G821-60: Dainippon Ink and Chemicals, Incorporated The coating liquid noted above was coated on an SUS plate of 100 $\mu$m thickness by dipping, hardened at 120° C. for 1 hr, and dried to make a layer thickness restriction member having a surface layer thickness of 20 $\mu$m.

Evaluation Items and Evaluation Methods (i) Toner Charge Amount (q/m), Developing Amount (m/a), Toner Releasability Test The layer thickness restriction member was loaded in the developing apparatus shown in FIG. 1. The developer bearing member 20 had an electroconductive elastic layer ($10^5$ Ω, urethane rubber of 4 mm thickness)/surface layer (silicone resin 20 μm) layer structure; electroconductive urethane sponge was used for the supply roller and color toner type F (cyan) made by Ricoh for the toner 24.

The developer bearing member 20 and supply roller were grounded and an idling test (developer bearing member 20 linear speed=100 mm/sec, supply roller linear speed=120 mm/sec) was conducted for 500 hr, and the initial and post-test toner q/m and m/a were measured (using a suction method). The thin toner layer condition was also observed visually. After the test, the toner 24 adhering to the surface of the layer thickness regulating member 21 was removed with an air gun, and the toner removability was evaluated according to the ranks noted below.

(ii) Coefficient of Static Friction (μ)

The coating liquid described earlier was coated onto a 16ϕ Al roller and hardened under the same conditions to fabricate a roller for making μ measurements. The measurements were conducted using an oiler belt scheme and μ was calculated. The friction opposition item is PPC paper type 6200 made by Ricoh. The calculation formula is represented below.

$$\mu = \ln(\text{measured value}/F)/(\pi/2)$$

(where F is the measurement load)

TABLE 2

| example/ characteristics | initial q/m | initial m/a | after test q/m | after test m/a | thin layer uniformity | releasability | μ |
|---|---|---|---|---|---|---|---|
| embodiment 1 | −18.5 | 0.58 | −17.1 | 0.61 | no streaking or irregularities, good uniformity | Δ | 0.63 |
| embodiment 2 | −20.2 | 0.57 | −19.1 | 0.62 | same as above | Δ | 0.60 |
| embodiment 3 | −17.6 | 0.59 | −16.3 | 0.64 | same as above | Δ | 0.62 |
| embodiment 4 | −17.1 | 0.58 | −19.2 | 0.55 | same as above | ○ | 0.50 |
| embodiment 5 | −18.7 | 0.57 | −20.4 | 0.53 | same as above | ○ | 0.48 |
| embodiment 6 | −21.5 | 0.54 | −19.7 | 0.58 | same as above | ○ | 0.61 |
| comp. ex. 1 | −18.0 | 0.55 | −10.3 | 0.61 | streaking and thin layer irregularities occurred | x | 0.82 |
| comp. ex. 2 | −19.4 | 0.58 | −9.9 | 0.60 | same as above | x | 0.96 |

Note 1)
○: Can easily be removed with air gun
Δ: Can be removed with air gun (Usable ranks extend as far as the trangle.)
x: Difficult to remove toner with air gun
Note 2) Units
Toner charge amount q/m: μc/g
Developing amount m/a: mg/cm$^2$ Examples A-7 to A-12

Layer Thickness Restriction Member Formula and Toner Charge Amount q/m, Developing Amount m/a, and Coefficient of Friction μ Evaluation Results:

A coating liquid was fabricated from the materials noted in Table 3, and a layer thickness restriction member was formed in the same manner as in Example C 1 to 6. The toner charge amount q/m, developing amount m/a, and coefficient of friction μ evaluations are noted in Table 3.

TABLE 3

| material/ example | ex. 7 | ex. 8 | ex. 9 | ex. 10 | ex. 11 | ex. 12 |
|---|---|---|---|---|---|---|
| 6-nylon containing methylmethoxy group | 100 | 100 | 100 | 100 | 100 | 100 |
| silane coupling agent *5 | 5 | | | | | |
| silane coupling agent *6 | | 5 | | | | |
| silane coupling agent *7 | | | 5 | | | |
| silane coupling agent *8 | | | | 5 | | |
| silane coupling agent *9 | | | | | 5 | |
| silane coupling agent *10 | | | | | | 5 |
| Toner charge amount q/m | −18.3 | −17.3 | −17.2 | −23.8 | −25.4 | −22.1 |
| Developing amount m/a | 0.56 | 0.55 | 0.59 | 0.54 | 0.57 | 0.59 |
| Coefficient of friction μ | 0.41 | 0.35 | 0.42 | 0.39 | 0.36 | 0.38 |

(parts by weight)

Note 1) silane coupling agent:
*5 KBM503: Acrylic-based silane coupling agent: Shin-Etsu Chemical Co., Ltd.
*6 KBM1063: Olefin-based silane coupling agent: Shin-Etsu Chemical Co., Ltd.
*7 KBM803: Mercapto group containing silane coupling agent: Shin-Etsu Chemical Co.
*8 KBM903: Monoaminosilane coupling agent: Shin-Etsu Chemical Co., Ltd.
*9 KBM603: Diaminosilane coupling agent: Shin-Etsu Chemical Co., Ltd.
*10 KBM6063: Daminosilane coupling agent: Shin-Etsu Chemical Co., Ltd.

Examples A-13 to A-17

Carbon black (Printex 90 made by Degusa) was milled and dispersed in nylon and an aminosilane coupling agent as in Example A-10, a layer thickness restriction member was fabricated by the same method as in Examples A-1 to A-12, and the electrical resistance of the layer thickness restriction member was controlled by adjusting the carbon dispersion amount. The toner charge amount q/m and developing amount m/a were also measured by the same method.

Next, the developing apparatus was brought into contact with the OPC photo-sensitive member 1, and the reverse charged toner amount was evaluated by the following method. In terms of process conditions, the linear speeds were 100 mm/sec for the developer bearing member 20, 120 mm/sec for the supply roller, and 66 mm/sec for the OPC photo-sensitive member 1, with potentials of +400 v on the developer bearing member 20, +250 v on the supply roller, and 0 v on the photo-sensitive member 1.

After developing the reverse charged toner 24 on the photo-sensitive member 1 under the conditions noted above, tape transfer was effected and affixed to white paper, and the image density was measured with a Macbeth densitometer. A non-transfer tape was also measured, and the reverse charged toner amount (ΔID) was calculated by the following formula.

$$\Delta ID = ID\ (\text{developed}) - ID\ (\text{not transferred})$$

The results of measuring the layer thickness restriction member volume resistance and ΔID are given in Table 4.

| example | ex. 13 | ex. 14 | ex. 15 | ex. 16 | ex. 17 |
|---|---|---|---|---|---|
| volume resistance | $5.5 \times 10^{13}$ | $1.2 \times 10^{13}$ | $6.1 \times 10^{12}$ | $3.5 \times 10^{11}$ | $2.4 \times 10^{10}$ |
| Δ ID | 0.09 | 0.08 | 0.05 | 0.03 | 0.01 |

Example A-18

Layer Thickness Restriction Roller Fabrication:

The electroconductive elastic layer (12 ϕ, made of epichlorohydrine rubber, layer thickness of 3 mm, $10^8$ Ω, rubber hardness JISA 58°) was spray-coated with the material of Example A-11 and hardened at 120° C. for 1 hr. Then the surface was ground to yield a layer thickness restriction roller 21 having a surface layer thickness of 15 μm. This was loaded in the developing apparatus shown in FIG. 3. For the developer bearing member 20, moreover, an Al roller the surface whereof had been subjected to a sandblasting treatment was used.

An idling test was conducted by the same method as in Example A-1 for 500 hr, yielding a stable thin layer exhibiting no streaking or irregularity.

Examples A-19 to A-22

The material used in Example A-6 was spray-coated onto an electroconductive elastic layer like that in Example A-18 to yield an elastic layer thickness restricting roller. Using exactly the same method as in Example A-19, rollers were fabricated with 20 parts by weight (Example A-20), 30 parts by weight (Example A-21), and 35 parts by weight (Example A-22) melamine resin to 100 parts by weight nylon.

These were subjected to idling tests by the same method as in Example A-18 for 500 hr. As a result of observing surface layer fractures with a 200-power microscope, no fractures whatever were found to have developed in Examples A-19 and A-20. In Example A-21, three crack fractures were found to have developed in regions within 5 mm of either end of the roller (regions where no images are formed), but these regions, and the extent of the fractures, were such as to present no problem in practice. In Example A-22, fracturing occurred in the center part (part where images are formed), and the thin toner layer in the fractured portion was uneven.

Example A-23

The layer thickness regulating member 21, developer bearing member 20, and developing apparatus used in Example A-1 were loaded in the electrophotographic apparatus shown in FIG. 20, and a 100,000-page running test was conducted. The toner charge amount q/m and developing amount m/a, and the amount of toner deposition on the background of the images, were measured before and after the test.

TABLE 5

| example | q/m | m/a | toner deposition on the background of images |
|---|---|---|---|
| before test | −19.6 | 0.55 | 0.01 |
| after test | −17.3 | 0.59 | 0.01 |

Note 1) Units
Toner charge amount q/m: mc/g
Developing amount m/a: mg/cm2

After the test, no toner adherence was found on the layer thickness regulating member 21.

With the embodiment of the present invention, as described in the foregoing, by forming at least the surface of the layer thickness regulating member so that it consists mainly of a cross-linked alkylalkoxyl-group-containing nylon resin, a developing apparatus is obtained having a layer thickness regulating member exhibiting positive frictional electrostatic charging characteristics and outstanding releasability, with no occurrence of toner sticking.

Also, by crosslinking the nylon resin having the alkylalkoxyl group with a silane coupling agent, the surface coefficient of friction declines, a thin layer can be formed that is even more uniform and stable, and torque can be reduced.

Also, by using an aminosilane coupling agent as the coupling agent for the cross-linked alkylalkoxyl-group-containing nylon resin, the toner charge amount is increased.

Moreover, by making the volume resistance of the material formed on the surface comprising mainly of a nylon resin having the alkylalkoxyl group $10^{12}$ Ωcm or less, the amount of reverse charged toner on the developer bearing member is reduced. Also, by at least the surface of the layer thickness regulating member having an elastic layer having a configuration formed so as to consist mainly of a nylon resin having the alkylalkoxyl group, a uniform, smooth, thin layer can be obtained even when the developer bearing member is rigid. Furthermore, by having the material comprising mainly of the nylon resin having the methylmethoxyl group made by the addition of a crosslinking agent, and making the amount of that crosslinking agent added to be 30 parts by weight or less to 100 parts by weight of the nylon resin having the alkylalkoxyl group, a layer thickness regulating member is obtained wherein fractures do not occur even when formed on an elastic layer.

Furthermore, by loading the developing apparatus in a electrophotographic apparatus, the toner electrostatic charging characteristics stabilize, and it is possible to provide an electrophotographic apparatus can be provided wherein images exhibiting little toner deposition on the background are stably obtained.

The present invention is next described specifically in terms of Examples relating to a developing apparatus in which at least the surface of a layer thickness regulating member is made of a material mainly comprising of cyclic polyolefin, but the present invention is not limited thereby.

Example B-1

100 parts by weight of an cyclic polyolefin (product name Apel APL 6509, made by Mitsui Petrochemical Industry, Ltd., glass transition point=80° C.) were dissolved in 500 parts by weight of toluene and spray-coated onto an SUS roller (12 ϕ). This was dried for 1 hour at 120° C. to yield a thin layer roller having a film thickness of 20 μm.

This thin layer roller was loaded in the developing apparatus shown in FIG. 10 and subjected to idling for 100 hours under the conditions noted below.

The toner charge amount (q/m), and the amount of adherence (m/a) before and after idling, were measured. The surface toner after idling were removed by air blowing, and the toner aggregate adherence condition and toner filming were evaluated by the evaluation methods noted below. The results are given in Table 6.

Developing Apparatus

Developer roller: 6 ϕ, linear speed 100 mm/s Epichlorohydrine rubber 4 mm elastic layer/silicone resin surface layer Supply roller: 12 ϕ, linear speed 120 mm/s Electroconductive urethane sponge Thin layer roller: 12 ϕ, linear speed 20 mm/s Bias: All rollers grounded, 0 v Toner: Cyan toner type 5100 (made by Ricoh)

Evaluation methods

Toner charge amount, adherence amount: Blow-off method

Aggregate adherence condition: By visual and microscopic observation of the surface (microscope made by Keyence, Japan.)

Toner filming: Evaluated by ΔID (toner filming) defined by following formula.

$$\Delta ID \text{ (toner filming)} = ID \text{ (after idling)} - ID \text{ (Ref)}$$

ID (after idling), ID (Ref):

For ID (after idling)—thin layer roller surface tape-transferred after air blowing, affixed onto paper type 6000 made by Ricoh, ID measured by Macbeth densitometer;

For ID (Ref)—measured ID in same manner with non-transferred tape.

Allowable range: For δ ID (toner filming), 0.05 or less is allowable range.

Example B-2

Except for changing the cyclic polyolefin in Example A-1 to Apel APL 6011 (product name) made by Mitsui Petrochemical Industries Ltd. glass transition point: 105° C.), a thin layer roller was fabricated in the same way as in Example B-1 and evaluated. The results are given in Table 6.

Comparative Example B-1

Without using a cyclic polyolefin, a change was made to a PTFE (polytetrafluoroethylene) coating material (made by Daikin Industries, Ltd., product name: EK4100), this was spray-coated in the same manner as in Example A-1, and sintered at 280° C. for 1 hour to yield a thin layer roller having a film thickness of 15 μm.

This thin layer roller was evaluated in the same way as in the examples. The results are given in Table 6.

Comparative Example B-2

To 100 parts by weight of a solvent-soluble fluorine resin (made by Asahi Glass Company, product name: Rumifuron 600) used instead of the PTFE coating material of comparative example B-1 were added 30 parts by weight of an isocyanate hardener (made by Asahi Glass Company, product name: Hardener for Rumifuron 600), 300 parts by weight of xylene, and 150 parts by weight of methylisobutylketone, and, after spray-coating this in like manner, it was hardened at 150° C. for 30 minutes to yield a thin layer roller having a film thickness of 20 μm. This thin layer roller was evaluated in the same manner as in the examples. The results are given in Table 6.

TABLE 6

| example | ex. 1 | ex. 2 | comp. ex. 1 | comp. ex. 2 |
|---|---|---|---|---|
| initial q/m | −15.2 | −16.7 | −3.3 | −9.8 |
| m/a | 0.59 | 0.6 | 0.48 | −55 |
| after idling q/m | −16.4 | −15.1 | — | −6.5 |
| m/a | 0.55 | 0.58 | — | 0.61 |

TABLE 6-continued

| example | ex. 1 | ex. 2 | comp. ex. 1 | comp. ex. 2 |
|---|---|---|---|---|
| thin layer streaking, irregularities | none | none | thin layer irregularities prominent | streakiong lasted for 5 hours |
| Δ ID (filiming) | 0.03 | 0.03 | — | 0.12 |

q/m; μ c/g
m/a; mg/cm$^2$

The fluorine resin in comparative example B-1 exhibited a low toner charge amount, thin layer irregularities developed, and the characteristics over time could not be evaluated.

Examples B-3 to B-6

After dissolving the cyclic polyolefin used in Example B-1 in toluene in the same manner, 5 parts by weight of the positive charge controlling agent indicated in Table 7 were added to 100 parts by weight of the cyclic polyolefin and ball mill dispersion was performed for 72 hours. A thin layer roller was fabricated in the same way as in Example B-1. This was loaded in the developing apparatus used in Example B-1, and the toner charge amount and adherence amount were measured. Next, the ΔID (reverse charged toner) was evaluated by the method indicated below. The results are given in Table 7.

ΔID (Reverse Charged Toner) Evaluation Method

The developing apparatus shown in FIG. 10 was brought into contact with a belt OPC photo-sensitive member, developing was performed under conditions corresponding to the image primer portion noted below, and the toner ΔID on the OPC was measured.

Developing Conditions

Potential on members: Developer, supply, and thin layer rollers +400 v, belt OPC 0 v Linear speed of members: Belt OPC 66.6 mm/s, rollers same as in Example A-1

$$\Delta ID \text{ (reverse charger toner)} = ID \text{ (toner on the } OPC) - ID \text{ (Ref)}$$

Allowable range: Allowable range for ΔID (reverse charge toner) is 0.05 or lower.

TABLE 7

| example | ex. 3 | ex. 4 | ex. 5 | ex. 6 | comp. ex. 1 |
|---|---|---|---|---|---|
| charge controlling agentproduct name | Bontron P-51 | TP-302 | HVK21 | Leorex AS170 | none |
| manufacturer | Orient Chemiocal Industries, Ltd | Hodogaya Chemical Industries, Ltd. | Hoechster Porzellan | Dai-ichi Kogyo Seiyaku., Ltd. | — |
| q/m | −20.4 | −21.6 | −20.0 | −23.4 | −15.5 |
| m/a | 0.59 | 0.61 | 0.55 | 0.60 | 0.60 |
| Δ ID (reverse charged toner) | 0.03 | 0.03 | 0.02 | 0.01 | 0.05 |

q/m; μ c/g
m/a; mg/cm$^2$

Examples B-7 to B-9

40 parts by weight of carbon black (made by Cabot, product name: BP-L) were added to 100 parts by weight (solid equivalent) of the toluene solution of cyclic polyolefin used in Example B-1 and ball mill dispersion was performed for 72 hours to fabricate a carbon master batch for controlling resistance.

Using that master batch, coating materials containing the quantities of carbon noted in Table 8 were prepared and spray-coated in the same manner as in example B-1 to yield thin layer rollers having surface layers of different volume resistance. These thin layer rollers were loaded into the developing apparatus shown in FIG. 10, and ΔID (reverse charging toner deposition on the background of images) was measured by the same method as in examples B-3 to B-6. The results are given in Table 8.

Potential on members: Developer and supply rollers +400 v, thin layer roller +200 v, belt OPC 0 v

TABLE 8

| example | ex. 7 | ex. 8 | ex. 9 | ex. 1 |
|---|---|---|---|---|
| amount of carbon added | 20 | 30 | 40 | 0 |
| volume resistance | $1.8 \times 10^{13}$ | $5.6 \times 10^{12}$ | $4.4 \times 10^{11}$ | $2.4 \times 10^{15}$ |
| Δ ID (reverse charged toner) | 0.06 | 0.02 | 0.01 | 0.05 |

amount of carbon added: parts by weight to 100 parts by weight polyolefin volume resistance: Ω · cm (DC100V 1 minute value)

Examples B-10, B-11

To the epichlorohydrine rubber (Epichloromer CG made by Daiso Co., Ltd., rubber hardness JISA 50 degrees, layer thickness 2 mm) (Example B-10) used in the developer roller in Example B-3 and the carbon black-added electroconductive silicone rubber (rubber hardness JISA 60 degrees, layer thickness 2 mm) (Example B-11), respectively, the surface layer used in Example B-8 was spray-coated to fabricate a thin layer roller in the same manner. This was loaded in the developing apparatus shown in FIG. 10, idling operation was performed continuously for 100 hours by the same method as in embodiment 1, and the surface was observed with a microscope (VH5900 made by Keyence, Japan) at a magnification of 200, but no toner aggregate adherence or filming or the like was found.

Examples B-12 to B-14

0.3 part by weight of polyethylene wax (made by Mitsui Petrochemical Industries, Ltd.) was added to 100 parts by weight (solid equivalent) of the toluene solution of cyclic polyolefin used in Example B-1 and ball mill dispersion was conducted for 72 hours. After that, a thin layer roller was fabricated in exactly the same manner as in Example B-1.

The surface coefficient of friction was calculated from the formula below by the oiler belt scheme. The results are given in Table 9.

$$\mu s = 2/\pi \times 1n\ (F/w)$$

$\mu s$: coefficient of static friction, F: measured value, w: load (100 g)

It is preferable that $\mu s$ be from 0.20 to 0.55. Above 0.55, the torque with the contacting members such as the developer roller and scraper increases, and jitter and the like readily occur. Below 0.20, slipperiness becomes excessive, it becomes difficult to restrict the thin toner layer, and thin layer uniformity is impaired.

TABLE 9

| example | ex. 12 | ex. 13 | ex. 14 | ex. 1 |
|---|---|---|---|---|
| product name | HI-WAX 400P | HI-WAX NL800 | HI-WAX HW1140 | not added |
| $\mu$ s | 0.28 | 0.25 | 0.27 | 0.51 |

Figure 10:
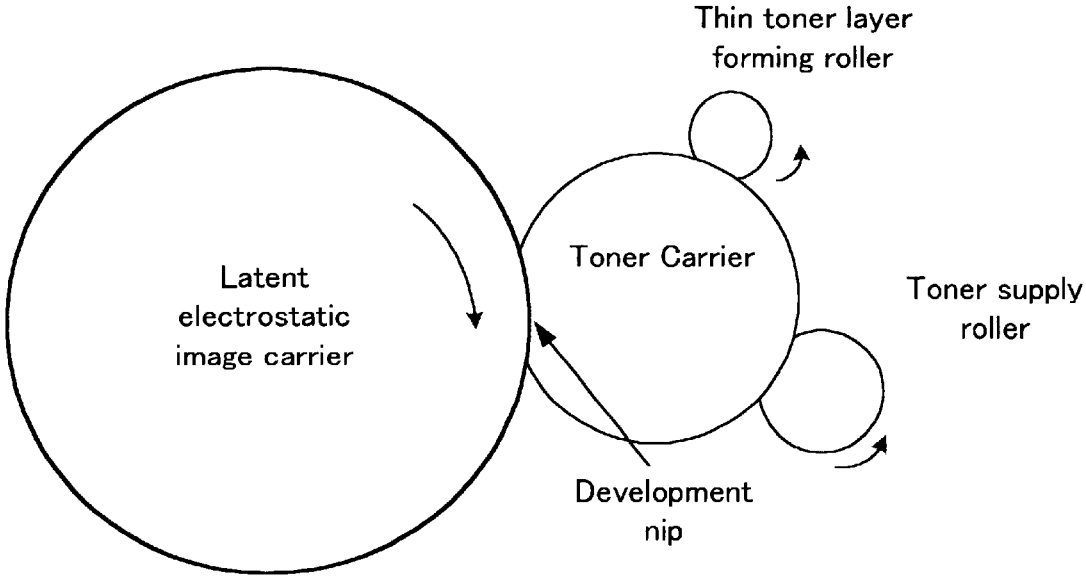
FIG. 10 is a schematic view showing an example of the configuration relating to a thin layer roller having a thin layer roller, that is an embodiment of the present invention.

A developing apparatus wherein the thin layer roller used in Example B-8 was loaded into the image forming apparatus shown in FIG. 2, and 10,000 pages of printing were continuously performed. When the image (toner deposition on the background of images) and the surface of the thin layer roller after printing were observed under magnification in the same manner as in examples B-10 and B-11, the image (toner deposition on the background of images) was good, there was no toner aggregate adherence on the thin layer roller surface and filming had not occurred.

Based on the embodiment of the present invention, by configuring at least the surface of the layer thickness regulating member with a material comprising of a cyclic polyolefin, toner aggregate adherence to the thin layer roller surface and toner filming are prevented and a stable thin toner layer can be obtained.

Based on the present invention, moreover, toner electrostatic charging characteristics are improved, the amount of reverse charged toner that occurs is particularly reduced, and an image forming apparatus wherein the developing apparatus of the present invention is loaded can provide images of high image quality, with little toner deposition on image backgrounds, and wherein the occurrence of jitter or the like is prevented.

The present invention is now described further, citing examples and comparative examples, relating a developing apparatus of the present invention in which at least the surface of the developer bearing member comprises a material including a polyimide denatured silicone. It should be noted that the present invention is not limited to or by the examples described below.

Example C-1

<Developer Roller Surface Layer Formation Components>

100 parts by mass of polyimide denatured silicone resin (X-22-8917, made by Shin-Etsu Chemical Co., Ltd.)

100 parts by mass of cyclohexanone 100 parts by mass of methylethyl ketone

The coating liquid noted above was coated by dipping onto an SUS plate (thickness 0.1 mm), and that was left standing in a constant temperature tank at 200° C. for 1 hour to make a specimen plate (film thickness 20 $\mu$m).

<Thin Layer Restricting Member Evaluation>

(1) Toner Releasability Test

Figure 11:
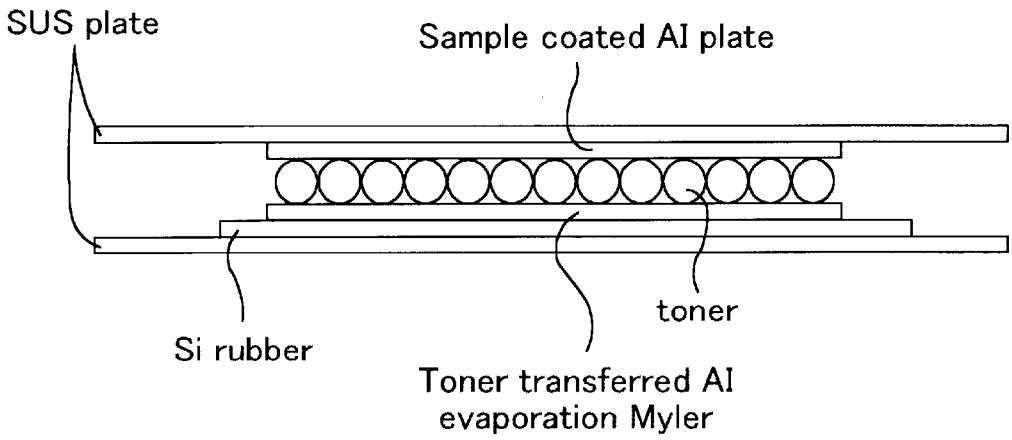
FIG. 11 is a view representing a test panel to which toner was brought into contact, used in toner releasability tests.

The specimen plate was brought into contact with toner (Ricoh cyan toner type 4100) as shown in FIG. 11, and heated and pressed under 980 kPa at 50° C. for 1 hr using a simple laboratory press molding machine. After the test, the toner was blown off with 294 kPa air, and the toner residue condition was visually evaluated by rank according to the following.

Releasability Ranks

Rank

8: Toner removed extremely easily

7: Toner completely removed though requiring some time

6: Toner slightly remains (a few % or less)

5: Toner remains from a few % to ⅓ thereof or so

4: Toner remains from ⅓ to ⅔ thereof or so

3: Toner remains ⅔ thereof or more

2: Toner remains on entire surface (present as toner particles)

1: Toner remains on entire surface (2) Idling test

Similar developer roller surface layer formation components were spray-coated on a 16 mm ϕ Al core metal, allowed to stand in a constant temperature tank at 200° C. for 1 hour, then taken out and slowly cooled, after which the surface was ground to make a developer roller. This was loaded in the developing apparatus shown in FIG. 6 and an idling test was performed for 100 hours. The following materials were used in the members of the developing apparatus.

Toner: Ricoh cyan toner (type 4100)

Thin layer blade: made of SUS, 100 μm thickness

Supply roller: Electroconductive urethane sponge

Linear speed: developer roller=100 mm/sec, supply roller=120 mm/sec

Potential: Developer roller=ground, Supply roller=−150 V, Thin layer restricting member=float During the idling, the thin layer condition of the toner was observed. After the idling, toner was blown off of the developer roller with air, residual toner on the surface was tape transferred, that was affixed to white paper, and the image density thereof was measured (measuring apparatus: X-Rite 938 Spectrodensitometer). Blank density was also measured, and the difference was made the index value ΔID (filming) of the amount of filming toner.

Next, the diameter of the developer roller was measured with a laser microgauge (LS3100 made by Keyence Japan), and the wear amount (am) was calculated from the difference before and after idling.

Example C-2

A specimen and roller were fabricated in exactly the same way as in Example C-1 except in that the polyimide denatured silicone resin (X-22-8917) used in Example C-1 was changed to the polyimide denatured silicone resin (X-22-8904, made by Shin-Etsu Chemical Co., Ltd.), and evaluations were made in the same manner.

Example C-3

<Synthesis of Polyimide Denatured Silicone Resin>

Into a four-mouth flask equipped with a dry nitrogen gas induction tube, cooler, thermometer, and stirrer, 791 g of dehydrated refined N-methyl-2-pyrrolidone (NMP) were introduced, vigorous stirring was done for 10 minutes under a nitrogen gas flow, then, to that, 0.10 mol of 2,2-bis(4-(4-aminophenoxy)phenyl)propane (BAPP) and 0.10 mol of diaminopolydimethylsiloxane (X-22-161AS, Shin-Etsu Chemical Co., Ltd.) were introduced, and the system was heated at 60° C. and stirred until uniform. Next, the system was cooled at 5° C. or lower in an ice water bath, 0.42 mol of anhydrous trimellitic acid was added, and stirring was continued for 3 hours thereafter, during which time the flask was maintained at 5° C. or lower. After that, the nitrogen gas induction tube and cooler were removed, a dean stak tube filled with xylene was mounted to the flask, and 198 g of xylene was added to the system. In an oil bath, the system was heated to approximately 175° C., and the water generated was removed from the system. After heating for 4 hours and observing that water was no longer being generated, the system was cooled, and this reaction solution was placed in a large volume of methanol and a resin was precipitated. After filtering out the solid portion, drying under reduced pressure was performed at 80° C. for 12 hours to remove the solvent, and the silicone denatured polyimide resin A was obtained.

The resin so obtained was fabricated into a specimen and roller in the same manner as in Example C-1, and evaluated in the same manner.

Comparative Example C-1

<Developer Roller Surface Layer Formation Components>

| | |
|---|---|
| Polyimide resin (UPILEX-S, Ube Industries, Ltd.): | 100 parts by mass |
| N methyl 2 pyrrolidone: | 500 parts by mass |

The materials noted above were fabricated into a specimen and roller in the same manner as in Example C-1 and subjected to evaluation in the same manner.

Comparative Example C-2

<Developer Roller Surface Layer Formation Components>

| | |
|---|---|
| Silicone resin (SR2411, Dow Corning Toray Silicone Co., Ltd.): | 100 parts by mass |
| Toluene: | 100 parts by mass |

The materials noted above were fabricated into a specimen and roller in the same manner as in Example C-1 and subjected to evaluation in the same manner.

Comparative Example C-3

<Developer Roller Surface Layer Formation Components>

| | |
|---|---|
| Epoxy denatured silicone resin (SR2115, Dow Corning Toray Silicone Co., Ltd.): | 100 parts by mass |
| Aminosilane coupling agent (SH6020, Dow Corning Toray Silicone Co., Ltd.): | 5 parts by mass |
| Toluene: | 100 parts by mass |

The materials noted above were fabricated into a specimen and roller in the same manner as in Example C-1 and subjected to evaluation in the same manner.

The results are given in Table 10.

TABLE 10

| example | releasing rank | thin toner layer while idling | Δ ID | wear amount μm |
|---|---|---|---|---|
| ex. 1 | 8 | uniform thin layer stably obtained | 0.03 | 4.5 |
| ex. 2 | 8 | same as above | 0.02 | 3 |
| ex. 3 | 7 | same as above | 0.04 | 4.9 |
| comp. ex. 1 | 3 | *note 1 | — | — |

TABLE 10-continued

| example | releasing rank | thin toner layer while idling | Δ ID | wear amount μm |
|---|---|---|---|---|
| comp. ex. 2 | 7 | Toner leakage with wear at roller ends | 0.04 | *note 3 |
| comp. ex. 3 | 5 | *note 2 | 0.07 | 8.9 |

*note 1: White streaks occurred in thin layer after approximately 4 hours, due to toner sticking. Stopped (test) after approximately 18 hours due to toner sticking over entire surface
*note 2: Innumerable white streaks occurred in thin layer, due to toner filming.
*note 3: Center 14.5 / Core metal exposed at ends

Example C-4

<Developer Roller Surface Layer Formation Components>

| | |
|---|---|
| Polyimide denatured silicone resin (X -22 -8904, Shin-Etsu Chemical Co., Ltd.) | 100 parts by mass |
| Cyclohexanone: | 100 parts by mass |
| Methylethyl ketone: | 100 parts by mass |
| Carbon black (Black Pearl L, Degusa): | 0, 15, 22, 30, and 45 parts by mass |

The carbon black noted above was added to the surface layer formation components used in Example C-2 and ball mill dispersion was conducted for 72 hours. That was then spray-coated to yield a developer roller in the same manner as in Example C-2. The surface layer film thickness is 15 μm.

The volume resistance of this developer roller was calculated using the following formula from the resistance value 1 minute later at DC 100 V.

$$\text{Volume resistance } R\ (\Omega\cdot\text{cm})=(\text{measured resistance value } R')\times\ln[(2\pi L)/a/b)]$$

where L is a main electrode width, a is a developer roller diameter, and b is a core metal diameter.

Figure 12:
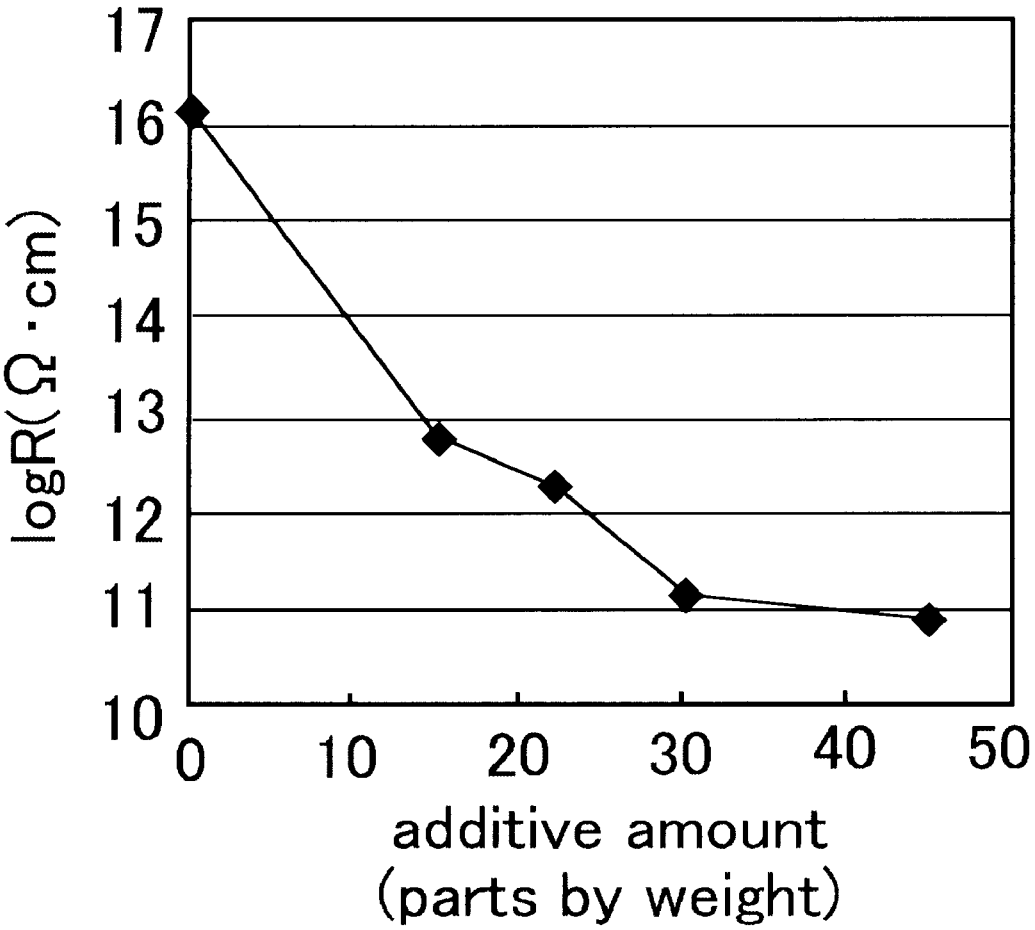
FIG. 12 is a graph representing the relationship between the quantity of carbon black added and volume resistance.

The results of measuring the amount of carbon black added and the volume resistance are represented in FIG. 12.

Next, this was developing roller loaded in a similar developing apparatus as in Example C-1, and the afterimage degree was measured using an image forming apparatus wherein a belt photo-sensitive member was used.

Afterimaging Evaluation

Figure 13:
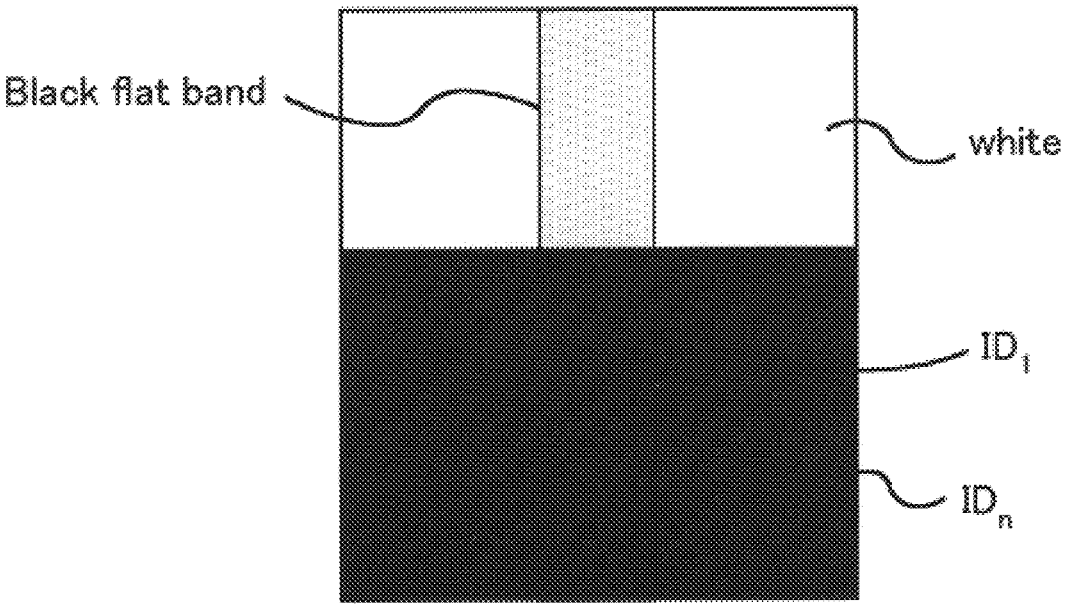
FIG. 13 is a view representing a pattern image output to evaluate afterimaging.

A pattern image like that indicated in FIG. 13 was output and afterimaging was evaluated. That is, the blacked out band in FIG. 13 (indicated by satinizing in the figure) was developed, then the net points were developed, the image density of the net points corresponding to the position of the blacked out band ($ID_l$) and the image density of the net points other than those corresponding to the blacked out band ($ID_n$) were measured with a Macbeth densitometer, and afterimaging was evaluated by the ratio therebetween ($ID_l/ID_n$). That is, if the ratio is 1, no afterimaging has occurred and that is good, but the more 1 is departed from, the worse the degree of afterimaging. The allowable range for the afterimaging degree is 1±0.1.

Figure 14:
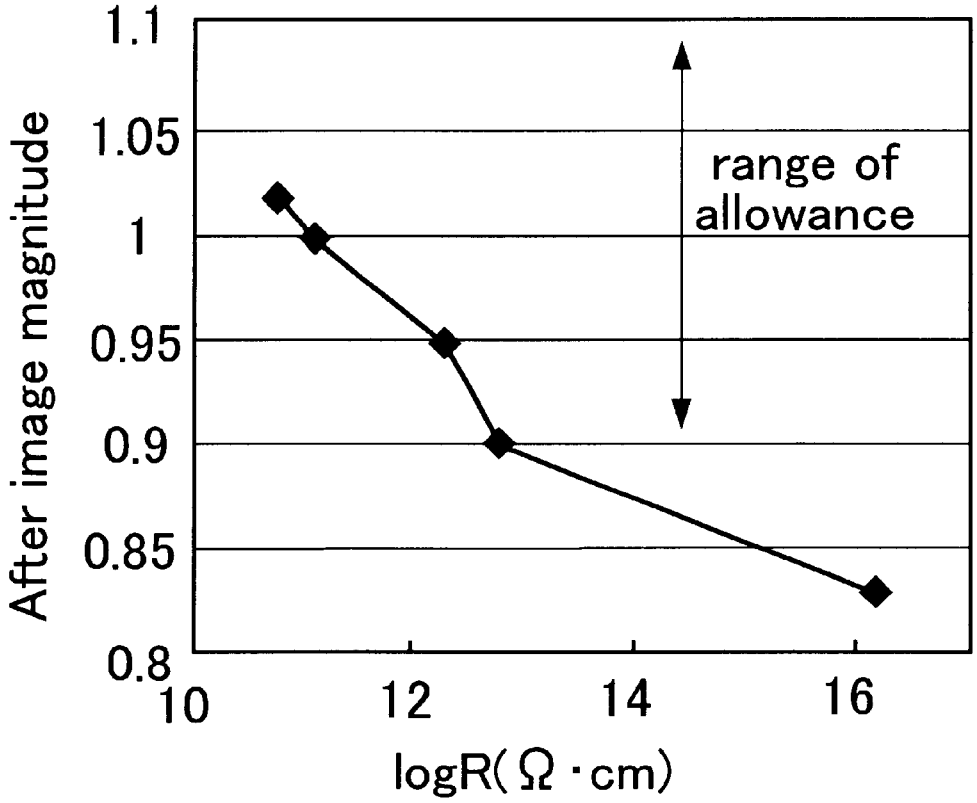
FIG. 14 is a graph representing the relationship between resistance and the afterimaging level.

The results of measuring the resistance and afterimaging degree are indicated in FIG. 14.

Example C-5

| <Elastic layer formation components) | |
|---|---|
| Silicone rubber (SH831U, Dow Corning Toray Silicone Co., Ltd.): | 100 parts by mass |
| Carbon black · thermal black (Asahi Carbon Co.): | 12 parts by mass |
| Vulcanizing agent (C8, Shin-Etsu Chemical Co., Ltd.): | 2 parts by mass |

The components noted above were kneaded with two rolls, and vulcanizing bonding molding with an 8ϕ SUS core metal coated beforehand with a bonding primer was performed, together with that core metal, in a molding die at 175° C. for 10 minutes. Secondary vulcanization was then performed in an oven at 200° C. for 4 hours, and grinding was done with a cylindrical grinder to yield an electroconductive elastic layer having a layer thickness of 4 mm (electrical resistance approximately $10^5$ Ω).

The developer roller surface layer formation components (part containing 30 parts by weight carbon black) used in Example C-4 were spray-coated onto the elastic layer noted above, and a developer roller was obtained by a similar method. The surface layer film thickness is 10 μm. This was loaded in an image forming apparatus wherein the drum photo-sensitive member indicated in FIG. 2 was used and a test was conducted in which 100,000 pages of paper were run through. The afterimaging degree before and after the test, and the ΔID releasability, wear amount, and fracturing (observed with a microscope) after the test were measured. The are results are given in Table 11.

TABLE 11

| after imaging degree before test | after imaging degree after test | ΔID releasability | wear amount | fracturing |
|---|---|---|---|---|
| 0.99 | 0.98 | 0.03 | 4.1 μm | none |

Example C-6

<Developer Roller Surface Layer Formation Components>

| | |
|---|---|
| Polyimide denatured silicone resin (X −22 −8904, Shin-Etsu Chemical Co., Ltd.): | 100 parts by mass |
| Cyclohexanone: | 100 parts by mass |
| Methylethyl ketone: | 100 parts by mass |
| Maleimide resin having a quaternary ammonium salt group (Leorex AS170, Dai-Ichi Kogyo Seiyaku Co., Ltd.): | 0, 5, 10, 15, 25, and 45 parts by mass |

The surface layer formation components noted above were formed on an elastic layer in the same manner as in Example C-5, and the volume resistance and ΔID (toner deposition on image background), toner charge amount, adherence amount, and afterimaging degree were measured. The results are given in Table 12.

TABLE 12

| after imaging degree before test | after imaging degree after test | ΔID releasability | wear amount | fracturing |
|---|---|---|---|---|
| 0.99 | 0.98 | 0.03 | 4.1 μm | none |

ΔID (toner deposition on image background); measuring apparatus: The image background toner deposition density was measured with an X-Rite 938 Spectrodensitometer Toner Charge Amount, Adherence Amount: Suction Method Based on the present invention, a developing unit (developing apparatus) is provided having a developer roller that, by containing a polyimide denatured silicone resin at least in the surface thereof, exhibits outstanding toner releasability and wear resistance.

Furthermore, an image forming apparatus wherein the developing apparatus of the present invention is used can provide images of high image quality with no afterimages over a long period of time.

What is claimed is:

1. A developing apparatus for developing a latent electrostatic image to a developed image with a developer, comprising:

a developer bearing member capable of bearing said developer on a surface portion of said developer bearing member, and a layer thickness regulating member for regulating a thickness of said developer on said developer bearing member to a uniform thickness, a surface portion of said layer thickness regulating member comprising a material which comprises at least one of a cross-linked alkylalkoxyl-group containing nylon resin and a cyclic polyolefin.

2. The developing apparatus according to claim 1, wherein said surface portion of said layer thickness regulating member has a volume resistivity of $10^{12}$ Ωcm or less.

3. The developing apparatus according to claim 1, wherein said layer thickness regulating member has an elastic layer.

4. The developing apparatus according to claim 1, wherein said layer thickness regulating member is a roller.

5. The developing apparatus according to claim 4, wherein said material comprises said cyclic polyolefin and a polyethylene wax.

6. The developing apparatus according to claim 4, wherein said material comprises said cyclic polyolefin, and a compound that is positioned, in triboelectric series, more to positive charge side than said polyolefin.

7. The developing apparatus according to claim 1, wherein said nylon resin containing crosslinked alkylalkoxyl group is obtained using 30 parts by weight or less of a crosslinking agent to 100 parts by weight of said nylon resin containing alkylalkoxyl group.

8. The developing apparatus according to claim 1, wherein said nylon resin containing crosslinked alkylalkoxyl group is obtained using a silane coupling agent as crosslinking agent.

9. The developing apparatus according to claim 8, wherein said silane coupling agent is an aminosilane coupling agent.

10. The developing apparatus according to claim 1, wherein said alkylalkoxyl group is a methylmethoxyl group.

11. The developing apparatus according to claim 1, wherein at least the surface portion of said developer bearing member comprises a material comprising polyimide denatured silicone.

12. The developing apparatus according to claim 1, wherein said surface portion of said developer bearing member has a volume resistivity of $10^{12}$ Ωcm or less.

13. The developing apparatus according to claim 1, wherein said developer bearing member has an elastic layer.

14. The developing apparatus according to claim 11, wherein said material of the developer bearing member comprises 15 parts by mass or more of at least one of a maleimide resin having a group of quaternary ammonium salt and a methacrylimide resin having a group of quaternary ammonium salt to 100 parts by mass of said polyimide denatured silicone.

15. A developing apparatus for supplying developer to latent electrostatic images and making said latent electrostatic images visible to form developed images, comprising:

a developer bearing member capable of carrying developer on a surface portion thereof; and a layer thickness regulating member for regulating developer carried on said developer bearing member to a uniform thickness;

wherein at least the surface portion of said developer bearing member comprises a material including a polyimide denatured silicone.

16. The developing apparatus according to claim 15, wherein said surface portion of said developer bearing member has a volume resistivity of $10^{12}$ Ωcm or less.

17. The developing apparatus according to claim 15, wherein said developer bearing member has an elastic layer.

18. The developing apparatus according to claim 15, wherein said material comprises 15 parts by mass or more of at least one of a maleimide resin having a group of quaternary ammonium salt and a methacrylimide resin having a group of quaternary ammonium salt to 100 parts by mass of said polyimide denatured silicone.

19. An image forming apparatus comprising:

a latent electrostatic image bearing means capable of bearing latent electrostatic images thereon, charging means for electrically charging a surface of said latent electrostatic image bearing means, exposing means for exposing the surface of said electrically charged latent electrostatic image bearing means to light imagewise so as to form a latent electrostatic image thereon corresponding to an image to be formed, a developing member comprising a developing unit for supplying a developer to said latent electrostatic image and developing said latent electrostatic image to a developed image with said developer, which developing unit comprises:

(a) a developer bearing member capable of bearing said developer on a surface portion of said developer bearing member, and (b) a layer thickness regulating member for regulating a thickness of a layer of said developer on said developer bearing member to a uniform thickness, a surface portion of said layer thickness regulating member comprising a material which comprises at least one of a cross-linked alkylalkoxyl-group-containing nylon resin and a cyclic polyolefin.

20. An image forming apparatus comprising:

a latent electrostatic image bearing means capable of bearing latent electrostatic images thereon, charging means for electrically charging a surface of said latent electrostatic image bearing means, exposing means for exposing the surface of said electrically charged latent electrostatic image bearing means to light imagewise so as to form a latent electrostatic image thereon corresponding to an image to be formed, a developing member comprising a developing unit for supplying a developer to said latent electrostatic image and developing said latent electrostatic image to a developed image with said developer, which developing unit comprises:

(a) a developer bearing member capable of bearing said developer on a surface portion of said developer bearing member, and (b) a layer thickness regulating member for regulating a thickness of said developer on said developer bearing member to a uniform thickness, a surface portion of said developer bearing member comprising a material containing a polyimide denatured silicone.

* * * * *